US006090748A

United States Patent [19]

Furuya et al.

[11] Patent Number: 6,090,748

[45] Date of Patent: Jul. 18, 2000

[54] REVERSIBLE THERMOSENSITIVE RECORDING MATERIAL AND RECORDING METHOD AND RECORDING APPARATUS THEREFOR

[75] Inventors: Hiromi Furuya; Tadafumi Tatewaki, both of Shizuoka-ken; Masafumi Torii; Fumio Kawamura, both of Shizuoka; Hiroaki Matsui, Numazu; Masaru Shimada, Shizuoka-ken; Kyoji Tsutsui, Mishima, all of Japan

[73] Assignee: Ricoh Company, Ltd., Tokyo, Japan

[21] Appl. No.: 09/104,720

[22] Filed: Jun. 25, 1998

[30] Foreign Application Priority Data

| | | | |
|---|---|---|---|
| Jun. 26, 1997 | [JP] | Japan | 9-185917 |
| Jun. 26, 1997 | [JP] | Japan | 9-185918 |
| Jun. 24, 1998 | [JP] | Japan | 10-193769 |

[51] Int. Cl.[7] ..... B41M 5/34

[52] U.S. Cl. ..... 503/201; 347/179; 503/209; 503/216; 503/217; 503/220; 503/221

[58] Field of Search ..... 503/200, 201, 503/216, 217, 221, 226, 220, 205, 208, 209; 347/179

[56] References Cited

U.S. PATENT DOCUMENTS

| | | | |
|---|---|---|---|
| 5,143,893 | 9/1992 | Mochizuki et al. | 503/227 |
| 5,229,189 | 7/1993 | Hiyoshi et al. | 428/195 |
| 5,250,346 | 10/1993 | Nagai et al. | 428/195 |
| 5,306,687 | 4/1994 | Furuya et al. | 503/207 |
| 5,380,693 | 1/1995 | Goto | 503/200 |
| 5,403,810 | 4/1995 | Sawamura et al. | 503/201 |
| 5,447,900 | 9/1995 | Suzaki et al. | 503/207 |
| 5,472,931 | 12/1995 | Morohoshi | 503/227 |
| 5,482,912 | 1/1996 | Furuya et al. | 503/207 |
| 5,489,501 | 2/1996 | Torii et al. | 430/341 |
| 5,521,138 | 5/1996 | Shimada et al. | 503/209 |
| 5,532,201 | 7/1996 | Goto | 503/213 |
| 5,547,500 | 8/1996 | Tsutsui | 106/21 A |
| 5,622,909 | 4/1997 | Furuya et al. | 503/216 |
| 5,641,724 | 6/1997 | Yamaguchi et al. | 503/221 |
| 5,679,615 | 10/1997 | Matsumoto et al. | 503/217 |
| 5,703,005 | 12/1997 | Torii et al. | 503/201 |
| 5,817,599 | 10/1998 | Iida et al. | 503/209 |

FOREIGN PATENT DOCUMENTS

| | | | |
|---|---|---|---|
| 2135466 | 8/1984 | United Kingdom . | |
| 2320582 | 6/1998 | United Kingdom . | |
| 9622885 | of 1996 | WIPO | 503/201 |

OTHER PUBLICATIONS

WPI Acc No.: 97–53758, Abstract of JP 090254545A (Sep. 1997) (Mitsubishi, Mar. 1996).

WPI Acc No.: 95–127979, Abstract of JP 070052553A (Feb. 1995) (Mitsubishi, Aug. 1993).

WPI Acc No.: 95–125933, Abstract of JP 070047766A (Feb. 1995) (Mitsubishi, Aug. 1993).

WPI Acc No.: 97–149289, Abstract of JP090024670A (Jan. 1997) (Ricoh), Jul. 1995).

WPI Acc No.: 96–338205, Abstract of JP080156410A (Jun. 1996) (Mitsubishi, Dec. 1994).

*Primary Examiner*—Bruce H. Hess

*Attorney, Agent, or Firm*—Cooper & Dunham LLP

[57] ABSTRACT

A reversible thermosensitive recording material which includes a recording layer including an electron donating coloring agent and an electron accepting coloring developer and in which an image is reversibly formed and erased by appropriately heating and cooling the recording layer, wherein the recording material has an image density retention not less than about 60% when the recording material having an image is allowed to settle in a dry place at 50° C. for 24 hours, a residual image density not greater than about 0.03 when the recording material having an image is heated at 110° C. for 0.5 seconds to erase the image, and a residual image density after light irradiation not greater than about 0.04 when the recording material having an image is heated at 110° C. for 0.5 seconds to erase the image after light of 5,000 lux is irradiated to the recording material for 100 hours.

15 Claims, 1 Drawing Sheet

REVERSIBLE THERMOSENSITIVE RECORDING MATERIAL AND RECORDING METHOD AND RECORDING APPARATUS THEREFOR

BACKGROUND OF THE INVENTION

1. Field of the Invention

The present invention relates to a reversible thermosensitive recording material, and a recording method and a recording apparatus therefor, and more particularly to a reversible thermosensitive recording material which utilizes a coloring reaction of an electron donating coloring agent and an electron accepting coloring developer and in which a colored image is repeatedly formed and erased by appropriately heating and cooling the reversible thermosensitive recording material, and a recording method and a recording apparatus therefor.

2. Discussion of the Related Art

A variety of thermosensitive recording materials are well known in which a colored image can be formed by a coloring reaction when an electron donating coloring agent is brought into contact with an electron accepting coloring developer while heat or the like is applied thereto.

The thermosensitive recording materials have the following advantages over other conventional recording materials:

(1) color images can be rapidly recorded by a relatively simple apparatus without using such complicated steps as developing and fixing;

(2) color images can be recorded without producing noise and environmental pollution;

(3) various color images, e.g., red, blue, violet and black, can be easily obtained;

(4) image density and background whiteness are high; and (5) the manufacturing cost is relatively low.

Because of these advantages, the above-described thermosensitive recording materials can be widely used, not only as a recording material for price labels in stores, but also as recording materials for copiers, printers for computers, facsimiles, automatic vending machines of tickets, video printers and measuring instruments.

However, the coloring reaction of these thermosensitive recording materials is irreversible and accordingly these recording materials cannot be repeatedly used.

Several thermosensitive recording materials which can reversibly form and erase an image have been proposed. For example, they are as follows:

(1) a thermosensitive recording material which includes gallic acid in combination with phloroglucinol serving as coloring developers (Japanese Laid-Open Patent Publication No. 60-193691);

(2) a thermosensitive recording material which includes phenolphthalein or Thymolphthalein serving as a coloring developer (Japanese Laid-Open Patent Publication No. 61-237684);

(3) a thermosensitive recording material which includes an uniform solid solution of a coloring agent, a coloring developer and a carboxylic acid ester (Japanese Laid-Open Patent Publications No. 62-138556, 62-138568 and 62-140881);

(4) a thermosensitive recording material which includes an ascorbic acid derivative serving as a coloring developer (Japanese Laid-Open Patent Publication No. 63-173684); and (5) a thermosensitive recording material which includes bis (hydroxyphenyl) acetic acid or a higher aliphatic amine salt of gallic acid serving as a coloring developer (Japanese Laid-Open Patent Publication No. 2-188294).

Some of the present inventors, jointly with others, have proposed a reversible thermosensitive coloring composition which includes a coloring agent such as a leuco dye and a coloring developer such as an organic phosphate compound, an aliphatic carboxylic acid compound or a phenolic compound each of which has a long-chain aliphatic hydrocarbon group, and a reversible thermosensitive recording material using the coloring composition (Japanese Laid-Open Patent Publication No. 5-124360). The reversible thermosensitive recording material can stably repeat image formation and image erasure by being appropriately heated and cooled, and the image-recorded state or the image-erased state can be stably maintained at room temperature. In addition, Japanese Laid-Open Patent Publication No. 6-210954 has disclosed a reversible thermosensitive recording material which includes a specified phenolic compound having a long-chain aliphatic hydrocarbon group serving as a coloring developer.

Thus reversible thermosensitive recording materials have been proposed; however, these recording materials do not have requisite properties of quick erasability and good preservability when they are used under various environmental conditions of temperature and humidity or when light is irradiated thereto. In attempting to improve the preservability, Japanese Laid-Open Patent Publications No. 7-164746 and 7-179043 have disclosed reversible thermosensitive recording materials which include a specified phenolic compound as a coloring developer. However, these recording materials cannot improve the preservability because an image recorded in the recording material cannot be clearly erased when the image is erased after light of 5000 lux is irradiated to the image for 100 hours. When these recording materials are in practical use in the market, a serious problem may occur in which information recorded in the recording materials is misunderstood.

In addition, these reversible thermosensitive recording materials have a drawback in that the image density deteriorates or the recording layer becomes deformed when images are repeatedly formed and erased in various environmental conditions of practical use of the recording materials (a problem hereinafter termed "deformation"). The reason for the deformation is considered to be that the structures of the recording layer and the protective layer of the recording material are gradually changed and deteriorated by the mechanical force and the heat of a thermal printhead which applies heat to the recording material to form or erase images.

In attempting to solve this problem, a reversible thermosensitive recording material has been disclosed which has a recording layer including particles whose average particle diameter is more than 1.1 times the thickness of the recording layer (Japanese Laid-Open Patent Publication No. 6-340171). In addition, a reversible thermosensitive recording material has been disclosed which has good ability to be used with thermal printheads owing to the formation of a protective layer thereon which has specified gloss and surface smoothness (Japanese Laid-Open Patent Publication No. 8-156410). However, these recording materials cannot yet entirely prevent the deterioration of the recording layer and the protective layer, which results in occurrence of deformation of the recorded image when the recording materials are repeatedly used. Therefore, these recording materials have a short life.

Further, Japanese Laid-Open Patent Publication No. 8-132738 has disclosed a reversible thermosensitive recording material which includes a compound selected from the group consisting of amide compounds, ester compounds, urea compounds and ketone compounds together with a dye having a lactone ring which serves as a coloring agent, an irreversible coloring developer having a phenolic hydroxy group and a resin having color erasability. This recording material is different from the reversible thermosensitive recording material which utilizes a coloring/decolorizing reaction of a coloring agent and a coloring developer and to which the present invention relates. In addition, this recording material has a drawback in that it takes a long time (about 30 seconds) to erase an image and therefore rapid image erasure is difficult when using the recording material.

Because of these reasons, a need exists for a reversible thermosensitive recording material which has such good image formation/erasure ability, good preservability, and good durability as to be able to be repeatedly used in market for a long time.

SUMMARY OF THE INVENTION

Accordingly, an object of the present invention is to provide a reversible thermosensitive recording material which has good image formation/erasure ability even when the recording material is repeatedly used under various environmental conditions of practical use.

Another object of the present invention is to provide a reversible thermosensitive recording material having quick erasability, good preservability and good durability without occurrence of deformation of the recording material.

The invention also embraces a recording method and a recording apparatus using such a reversible thermosensitive recording material.

To achieve such objects, the present invention contemplates the provision of a reversible thermosensitive recording material which includes a recording layer including a reversible thermosensitive coloring composition including an electron donating coloring agent and an electron accepting coloring developer and in which an image is reversibly formed and erased by appropriately heating and cooling the recording layer, wherein the recording material has preservability such that an image density retention of a recorded image is not less than about 60% when the image is preserved in a dry place at 50° C. for 24 hours, quick erasability such that an residual image density of an image is not greater than about 0.03 when the image is erased at 110° C. for 0.5 seconds, and erasability after light irradiation in which an residual image density of an image is not greater than 0.04 when the image is erased at 110° C. for 0.5 seconds after light of 5000 lux is irradiated to the image for 100 hours.

The recording layer includes at least one color formation/erasure controlling agent having a formula selected from the group consisting of the following formulas (1) and (2):

$$X1-(R1-X2)_n-R2 \quad (1)$$

wherein X1 represents a group including —CO—, —NH— or —O—; X2 represents a divalent group including —CO—, —NH— or —O—; R1 represents a divalent hydrocarbon group having carbon atoms of from 2 to 20, and when X1 is a carboxyl group, the R1 group adjacent to X1 is a linear hydrocarbon group having seven or more carbon atoms; R2 represents a hydrocarbon group having from 1 to 22 carbon atoms; and n is an integer of from 1 to 4, and when n is 2 or greater, each of R1 may be the same or different from each other and each of X2 may be the same or different from each other, and $$R2-Y1-(R1-Y2)_n-R2' \quad (2)$$

wherein Y1 and Y2 independently represent a divalent group including —CO—, —NH— or —O—; R1 represents a divalent hydrocarbon group having from 2 to 20 carbon atoms; each of R2 and R2, independently represents a hydrocarbon group having from 1 to 22 carbon atoms; and n is 0 or an integer of from 1 to 4, and when n is 2 or greater, each of R1 may be the same or different from each other and each of Y2 may be the same or different from each other.

In another embodiment of the present invention, a reversible thermosensitive recording method for the reversible thermosensitive recording material is provided, including the steps of recording by imagewise heating the recording layer of the recording material of the present invention at a temperature not lower than an image forming temperature to form a colored image in the recording material and erasing by heating the colored image at a temperature lower than the image forming temperature and not lower than an image erasing temperature.

In yet another embodiment of the present invention, a reversible thermosensitive recording apparatus for the reversible thermosensitive recording material is provided which includes an image forming device which imagewise heats the recording layer of the recording material at a temperature not lower than an image forming temperature to form an image in the recording layer when the recording layer is cooled, and an image erasing device which heats the recording layer at a temperature lower than the image forming temperature and not lower than an image erasing temperature to erase the image, wherein the image erasing device is selected from the group consisting of ceramic heaters, plane heaters, heat rollers, heat bars and thermal printheads.

These and other objects, features and advantages of the present invention will become apparent upon consideration of the following description of the preferred embodiments of the present invention taken in conjunction with the accompanying drawing.

DESCRIPTION OF THE PREFERRED EMBODIMENTS

Figure 1:
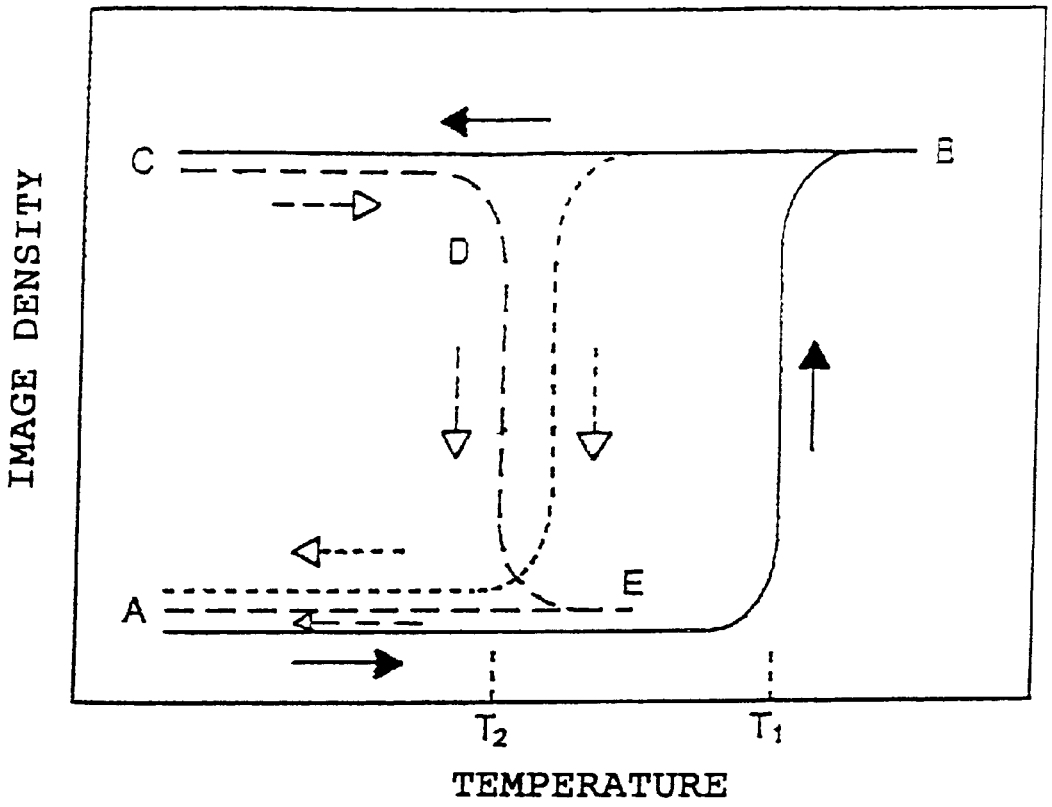
FIG. 1 is a graph illustrating the relationship between temperature and image density of a recording layer in an image recording and erasing cycle of a reversible thermosensitive recording material embodying the present invention.

FIG. 1 is a graph illustrating the relationship between temperature of a reversible thermosensitive recording material (hereinafter a recording material) and image density thereof. When the recording material which is in a non-colored state A is heated, the recording material begins to color at an image forming temperature T1 in which at least one of an electron donating coloring agent and an electron accepting coloring developer is melted and then achieves a melted colored state B. If the recording material in the melted colored state B is rapidly cooled to room temperature, the recording material keeps the colored state and achieves a cooled colored state C in which the electron donating coloring agent and the electron accepting coloring developer are almost solidified. It depends upon cooling speed whether the recording material remains in the colored state, and if the recording material is gradually cooled, the recording material returns to the non-colored state A (a dotted line B-A) or achieves a semi-colored state in which the image density of the recording material is relatively low compared to the image density of the recording material in the cooled colored state C. If the recording material in the cooled colored state C is heated again, the recording material begins to discolor at an image erasing temperature T2 lower than T1 and achieves a non-colored state E (a broken line C-D-E). If the recording material in the non-colored state E is cooled to room temperature, the recording material returns to the non-colored state A. The temperatures T1 and T2 depend on the materials of the coloring agent and the coloring developer. Accordingly, by appropriately selecting a coloring agent and a coloring developer, a recording material having desired T1 and T2 can be obtained. The image densities of the recording material in the colored states B and C are not necessarily the same.

In the colored state C, the recording layer includes the coloring agent and the coloring developer which form a solid in which a molecule of the coloring agent and a molecule of the coloring developer are mixed while contacting with each other. Namely, the coloring agent and the coloring developer cohere while they are reacting with each other, resulting in maintenance of the colored state. It is considered that the colored state C is stable because the semi-stable cohered structure of the coloring agent and the coloring developer is formed. On the other hand, in the non-colored state, at least one of the coloring agent and the coloring developer aggregates to form a domain, or crystallizes; thereby each phase of the coloring agent and the coloring developer which has a stable adhered structure is isolated from the other, and accordingly the recording material is stably in the non-colored state. In the recording materials of the present invention, the cohered structure of the coloring agent and the coloring developer is changed to a state in which the phases of the coloring agent and the coloring developer are isolated from the other and the coloring developer crystallizes; thereby color erasure can be perfectly performed. Namely, in the color erasure process of going from the colored state B to the non-colored state A when the recording materials are gradually cooled or going from the colored state C to the non-colored state A via the states D and E in FIG. 1, this structure change occurs at the image erasing temperature T2. The more stable the semi-stable cohered structure and the stable cohered structure of a recording material, the better the preservability of formed images and the erasability of the recording material.

The residual image density which means optical density of an erased image mainly depends on structure change of coloring agents. The present inventors have discovered that structure changes such as oxidation of coloring agents can be prevented by using a specified phenolic compound as a coloring developer and thereby a recording material having good erasability can be obtained. In addition, it is discovered that a recording material having good preservability (particularly at high temperature) and good erasability can be obtained by including a specified color formation/erasure controlling agent in the recording layer. The reason for the resultant improvement of the preservability is considered to be as follows:

(1) in a colored state of the recording material, the color formation/erasure controlling agent comes to be included in the cohered structure of the coloring agent and the coloring developer; and thereby a more stable cohered structure can be formed; and (2) in a non-colored state, the color formation/erasure controlling agent that has a strong cohered structure accelerates the crystallization of the coloring developer; and thereby images can be clearly erased.

The reversible thermosensitive recording material of the present invention has a substrate, a recording layer formed on the substrate and optionally a protective layer formed on the recording layer. The structure of the recording material of the present invention need not be limited to this structure. For example, the recording material may include an undercoat layer formed between the substrate and the recording layer, an intermediate layer formed between the recording layer and the protective layer, and a back-coat layer formed on the side of the substrate opposite to the side on which the recording layer is formed. In addition, the recording material may include a magnetic recording layer.

The present invention provides a reversible thermosensitive recording material which includes a recording layer including a reversible thermosensitive coloring composition including an electron donating coloring agent and an electron accepting coloring developer and optionally a resin and in which an image is reversibly formed and erased by appropriately heating and cooling the recording layer, wherein the recording material has preservability such that an image density retention of an image is not less than about 60% and preferably not less than about 70% when the image is preserved in a dry place (not greater than 40% RH and not greater than 30% RH as a severe condition) at 50° C. for 24 hours, quick erasability such that an residual image density is not greater than about 0.03 and preferably not greater than about 0.02 when an image is erased at 110° C. for 0.5 seconds, and erasability after light irradiation such that an residual image density is not greater than about 0.04 and preferably not greater than about 0.03 when an image is erased at 110° C. for 0.5 seconds after light of 5000 lux is irradiated to the image for 100 hours.

The image density retention is defined as follows:

$$\text{Image density retention (\%)} = \frac{(ID2 - GD2)}{(ID1 - GD1)} \times 100$$

wherein ID1 and ID2 represent image density of an image before and after the recording material having the image is preserved at 50° C. for 24 hours, respectively, and GD1 and GD2 represent background density of the image before and after the recording material having the image is preserved at 50° C. for 24 hours, respectively. The image density and background density can be measured with a conventional densitometer such as a reflection densitometer or a transmittance densitometer which is used for measuring the image density of an image formed on a transparent recording material.

The residual image density is defined as follows:

$$\text{Residual image density} = IDr - GD$$

wherein IDr represents a reflection (or transmittance) density of a portion of a recording material in which an image has been recorded and then erased, and GD represents a background density of the recorded image in the recording layer. The densities IDr and GD can be also measured with the densitometer mentioned above.

To obtain good preservability and quick erasability, the recording layer of the present invention includes at least one color formation/erasure controlling agent having a formula selected from the group consisting of the following formulas (1) and (2):

$$X1-(R1-X2)_n-R2 \quad (1)$$

wherein X1 represents a group including at least one of groups, —CO—, —NH— and —O—; X2 represents a divalent group including at least one of groups, —CO—, —NH— and —O—; R1 represents a divalent hydrocarbon group having from 2 to 20 carbon atoms, and when X1 is a carboxyl group, the R1 group adjacent to X1 is a linear hydrocarbon group having seven or more carbon atoms; R2 represents a hydrocarbon group having from 1 to 22 carbon atoms; and n is an integer of from 1 to 4, and when n is 2 or greater, each of R1 may be the same or different from each other and each of X2 may be the same or different from each other; and $$R2—Y1—(R1—Y2)_n—R2' \quad (2)$$

wherein Y1 and Y2 independently represent a divalent group including at least one of groups, —CO—, —NH— and —O—; R1 represents a divalent hydrocarbon group having from 2 to 20 carbon atoms; R2 and R2' independently represents a hydrocarbon group having from 1 to 22 carbon atoms; and n is 0 or an integer of from 1 to 4, and when n is 2 or greater, each of R1 may be the same or different from each other and each of Y2 may be the same or different from each other.

R1, R2 and R2' are optionally substituted with a hydroxide group, a halogen atom, an alkoxy group or the like. In addition, any one or more of R1, R2 and R2' may be an aliphatic hydrocarbon group or an aromatic hydrocarbon group, or a hydrocarbon group in which an aliphatic hydrocarbon group and an aromatic hydrocarbon group are combined. Further, the aliphatic hydrocarbon group may be linear or branched, and may include an unsaturated bonding.

The total carbon number (number of carbon atoms) of R1, R2 and R2' is preferably not less than 8, and more preferably not less than 11, to maintain good image formation/erasure properties.

Suitable groups for use as R1 include groups shown in Table 1.

TABLE 1

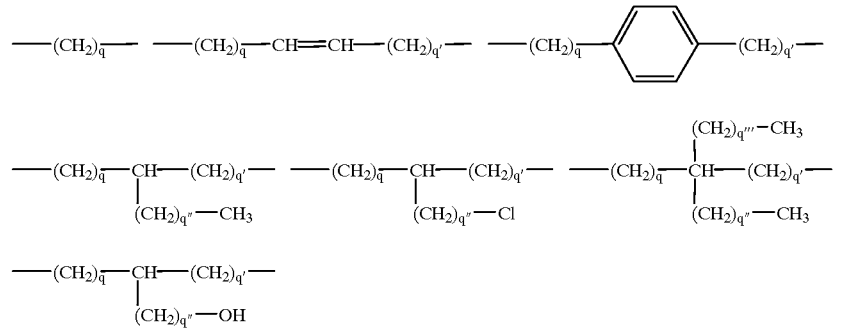

wherein q, q', q" and q'" are independently an integer not greater than the carbon number of R1 which is determined depending on the carbon numbers of R2 and R2', and the total carbon number in a group is not greater than the carbon number of R1.

Suitable groups for use as R2 or R2' include the groups shown in Table 2.

TABLE 2

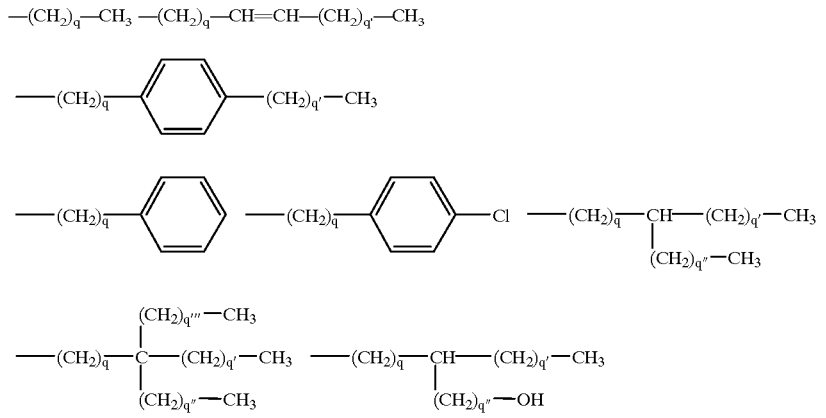

wherein q, q', q" and q'" are independently an integer not greater than the carbon number of R2 or R2' each of which is determined depending on the carbon numbers of R1 and R2' or R1 and R2, and the total carbon number in a group is not greater than the carbon number of R2 or R2'.

Suitable groups for use as X1 include the groups having at least one of groups, —NH—, —CO—, and —O—.

Specific examples of X1 include groups shown in Table 3.

TABLE 3

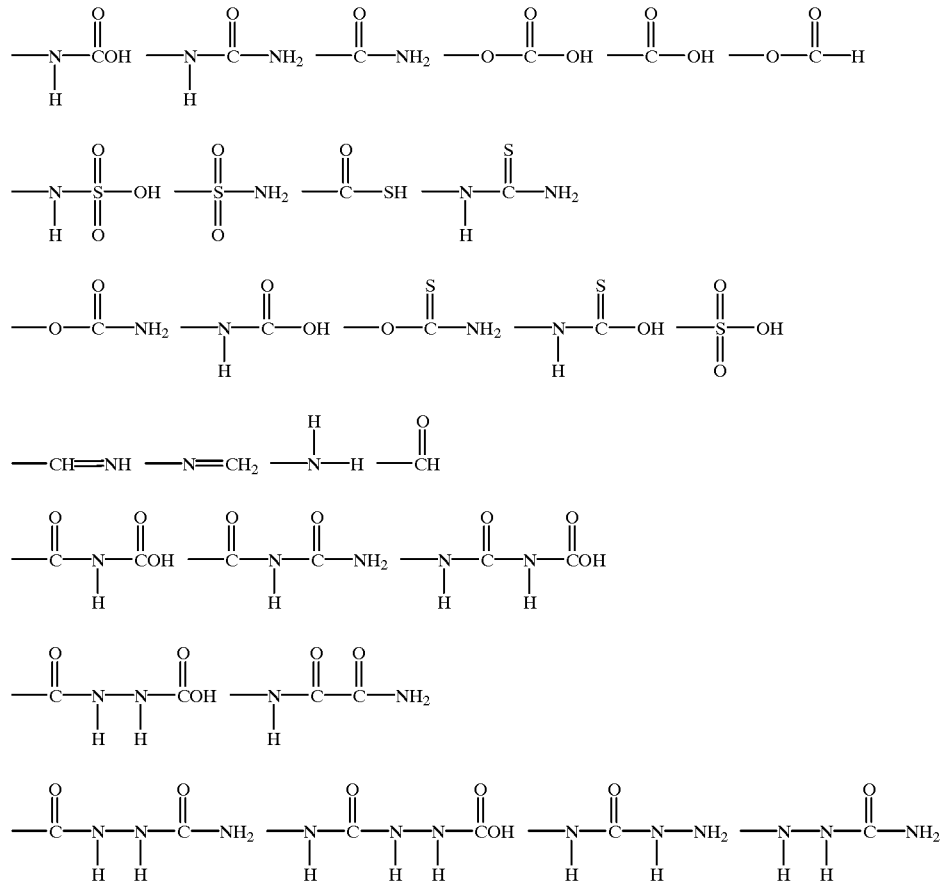

Suitable groups for use as X2, Y1 and Y2 include divalent groups having at least one of groups, —NH—, —CO—, and —O—.

Specific examples of X2, Y1 and Y2 include groups shown in Table 4.

TABLE 4

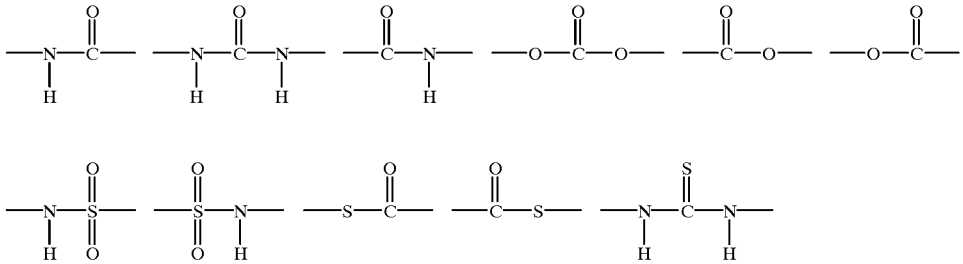

TABLE 4-continued

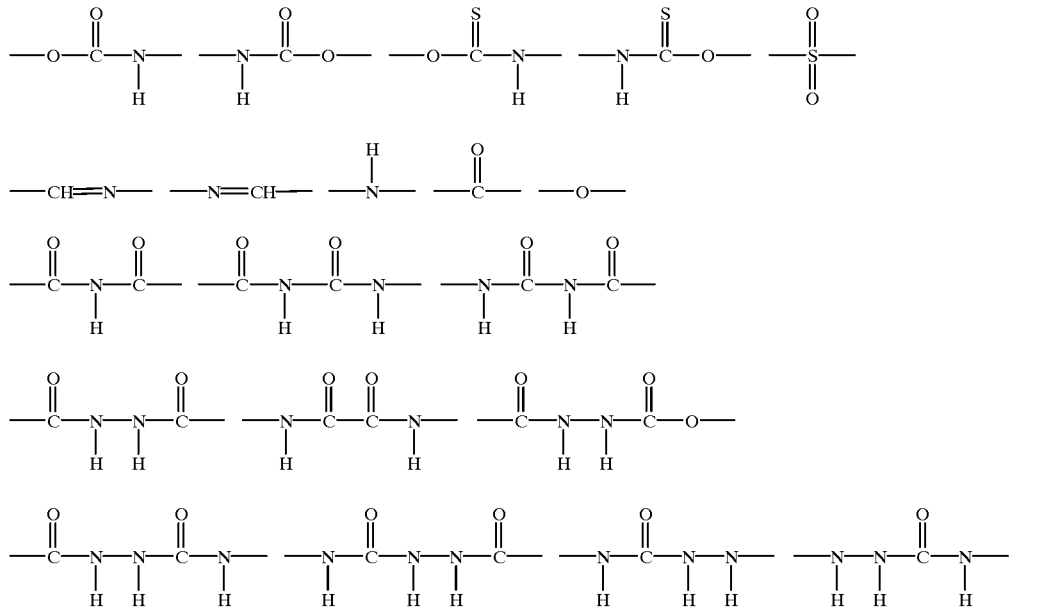

In the color formation/erasure controlling agents for use in the present invention, a compound having either one of the following formulas (9) and (10) has a color developing ability; however, it is observed that when the carbon number of R1 of the compound is 7 or more, the color developing ability thereof decreases and the color formation/erasure ability increases.

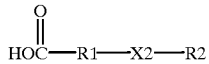

(9)

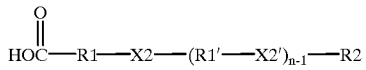

(10)

Suitable color formation/erasure controlling agents include compounds having the following formulas (11) to (14), but are not limited thereto:

$$X1—R1—X2—R2 \quad (11)$$

$$X1—R1—X2—(R1'—X2')_{n-1}—R2 \quad (12)$$

$$R2—Y1—R2' \quad (13)$$

$$R2—Y1—(R1—Y2)_n—R2' \quad (14)$$

wherein R1' and X2' independently represent one of the groups which are mentioned above for use as R1 and X2, and when n is 2 or more, each of R1' may be the same or different from each other and each of X2' may be the same or different from each other.

More suitable compounds for use as color formation/erasure controlling agents include compounds having the following formulas (15) to (18):

$$X1—(CH_2)_a—X2—(CH_2)_{m-1}CH_3 \quad (15)$$

$$X1—(CH_2)_a—X2—[(CH_2)_{a'}—X2']_{n-1}—(CH_2)_{m-1}CH_3 \quad (16)$$

$$CH_3(CH_2)_{m'-1}—Y1—(CH_2)_{m-1}CH_3 \quad (17)$$

$$CH_3(CH_2)_{m'-1}—Y1—[(CH_2)_a—Y2]_n—(CH_2)_{m-1}CH_3 \quad (18)$$

wherein a and a' are independently an integer of from 2 to 20, and m and m' are independently an integer of from 1 to 22.

Specific examples of such compounds having formula (15) include compounds shown in Table 5.

TABLE 5

| |
|---|
| $NH_2CO—(CH_2)_a—NHCONH—(CH_2)_{m-1}CH_3$ |
| $HOCO—(CH_2)_a—NHCONH—(CH_2)_{m-1}CH_3$ |
| $HO—(CH_2)_a—NHCONH—(CH_2)_{m-1}CH_3$ |
| $NH_2NHCO—(CH_2)_a—NHCONH—(CH_2)_{m-1}CH_3$ |
| $NH_2SO_2—(CH_2)_a—NHCONH—(CH_2)_{m-1}CH_3$ |
| $NH_2CONH—(CH_2)_a—NHCONH—(CH_2)_{m-1}CH_3$ |
| $NH_2COCONH—(CH_2)_a—NHCONH—(CH_2)_{m-1}CH_3$ |
| $NH_2CO—(CH_2)_a—NHCO—(CH_2)_{m-1}CH_3$ |
| $HOCO—(CH_2)_a—NHCO—(CH_2)_{m-1}CH_3$ |
| $HO—(CH_2)_a—NHCO—(CH_2)_{m-1}CH_3$ |
| $NH_2NHCO—(CH_2)_a—NHCO—(CH_2)_{m-1}CH_3$ |
| $NH_2SO_2—(CH_2)_a—NHCO—(CH_2)_{m-1}CH_3$ |
| $NH_2CONH—(CH_2)_a—NHCO—(CH_2)_{m-1}CH_3$ |
| $NH_2COCONH—(CH_2)_a—NHCO—(CH_2)_{m-1}CH_3$ |
| $NH_2CO—(CH_2)_a—NHCO—(CH_2)_{m-1}CH_3$ |
| $NH_2CO—(CH_2)_a—CONH—(CH_2)_{m-1}CH_3$ |
| $NH_2CO—(CH_2)_a—NHCOCONH—(CH_2)_{m-1}CH_3$ |
| $NH_2CO—(CH_2)_a—NHNHCONH—(CH_2)_{m-1}CH_3$ |
| $NH_2CO—(CH_2)_a—NHCONHNH—(CH_2)_{m-1}CH_3$ |
| $NH_2CO—(CH_2)_a—NHCONHNHCO—(CH_2)_{m-1}CH_3$ |

In addition, specific examples of such compounds having formula (16) include compounds similar to those shown in Table 5.

More specifically, examples of the compound having the formula, $HO—(CH_2)_a—NHCONH—(CH_2)_{m-1}—CH_3$, which is shown in Table 5 include compounds shown in Table 6.

TABLE 6

| |
|---|
| $HO—(CH_2)_2—NHCONH—(CH_2)_{17}CH_3$ |
| $HO—(CH_2)_3—NHCONH—(CH_2)_{17}CH_3$ |
| $HO—(CH_2)_5—NHCONH—(CH_2)_{17}CH_3$ |
| $HO—(CH_2)_7—NHCONH—(CH_2)_{17}CH_3$ |
| $HO—(CH_2)_9—NHCONH—(CH_2)_{17}CH_3$ |
| $HO—(CH_2)_{11}—NHCONH—(CH_2)_{17}CH_3$ |
| $HO—(CH_2)_{12}—NHCONH—(CH_2)_{17}CH_3$ |
| $HO—(CH_2)_5—NHCONH—(CH_2)_{21}CH_3$ |
| $HO—(CH_2)_5—NHCONH—(CH_2)_{20}CH_3$ |
| $HO—(CH_2)_5—NHCONH—(CH_2)_{19}CH_3$ |
| $HO—(CH_2)_5—NHCONH—(CH_2)_{14}CH_3$ |
| $HO—(CH_2)_{11}—NHCONH—(CH_2)_{21}CH_3$ |
| $HO—(CH_2)_{11}—NHCONH—(CH_2)_{14}CH_3$ |
| $HO—(CH_2)_{11}—NHCONH—(CH_2)_6CH_3$ |
| $HO—(CH_2)_{14}—NHCONH—(CH_2)_2CH_3$ |
| $HO—(CH_2)_{17}—NHCONH—CH_3$ |

Specific examples of such compounds having formula (17) include compounds shown in Table 7.

TABLE 7

| |
|---|
| $CH_3(CH_2)_{m'-1}—NHCONH—(CH_2)_{m-1}CH_3$ |
| $CH_3(CH_2)_{m'-1}—NHCO—(CH_2)_{m-1}CH_3$ |
| $CH_3(CH_2)_{m'-1}—NHCOCONH—(CH_2)_{m-1}CH_3$ |
| $CH_3(CH_2)_{m'-1}—NHCONHNH—(CH_2)_{m-1}CH_3$ |
| $CH_3(CH_2)_{m'-1}—NHSO_2NH—(CH_2)_{m-1}CH_3$ |
| $CH_3(CH_2)_{m'-1}—NHCOO—(CH_2)_{m-1}CH_3$ |
| $CH_3(CH_2)_{m'-1}—NHCO—(CH_2)_a—NHCONH—(CH_2)_{m-1}CH_3$ |
| $CH_3(CH_2)_{m'-1}—OCO—(CH_2)_a—NHCONH—(CH_2)_{m-1}CH_3$ |
| $CH_3(CH_2)_{m'-1}—O—(CH_2)_a—NHCONH—(CH_2)_{m-1}CH_3$ |
| $CH_3(CH_2)_{m'-1}—NHNHCO—(CH_2)_a—NHCONH—(CH_2)_{m-1}CH_3$ |
| $CH_3(CH_2)_{m'-1}—NHSO_2—(CH_2)_a—NHCONH—(CH_2)_{m-1}CH_3$ |
| $CH_3(CH_2)_{m'-1}—NHCONH—(CH_2)_a—NHCONH—(CH_2)_{m-1}CH_3$ |
| $CH_3(CH_2)_{m'-1}—NHCOCONH—(CH_2)_a—NHCONH—(CH_2)_{m-1}CH_3$ |
| $CH_3(CH_2)_{m'-1}—NHCO—(CH_2)_a—NHCO—(CH_2)_{m-1}CH_3$ |
| $CH_3(CH_2)_{m'-1}—OCO—(CH_2)_a—NHCO—(CH_2)_{m-1}CH_3$ |
| $CH_3(CH_2)_{m'-1}—O—(CH_2)_a—NHCO—(CH_2)_{m-1}CH_3$ |
| $CH_3(CH_2)_{m'-1}—NHNHOCO—(CH_2)_a—NHCO—(CH_2)_{m-1}CH_3$ |
| $CH_3(CH_2)_{m'-1}NHSO_2—(CH_2)_a—NHCO—(CH_2)_{m-1}CH_3$ |
| $CH_3(CH_2)_{m'-1}—NHCONH—(CH_2)_a—NHCO—(CH_2)_{m-1}CH_3$ |
| $CH_3(CH_2)_{m'-1}—NHCOCONH—(CH_2)_a—NHCO—(CH_2)_{m-1}CH_3$ |
| $CH_3(CH_2)_{m'-1}—NHCO—(CH_2)_a—NHCO—(CH_2)_{m-1}CH_3$ |
| $CH_3(CH_2)_{m'-1}—NHCO—(CH_2)_a—CONH—(CH_2)_{m-1}CH_3$ |
| $CH_3(CH_2)_{m'-1}—NHCO—(CH_2)_a—NHCOCONH—(CH_2)_{m-1}CH_3$ |
| $CH_3(CH_2)_{m'-1}—NHCO—(CH_2)_a—NHNHCONH—(CH_2)_{m-1}CH_3$ |
| $CH_3(CH_2)_{m'-1}—NHCO—(CH_2)_a—NHCONHNH—(CH_2)_{m-1}CH_3$ |
| $CH_3(CH_2)_{m'-1}—NHCO—(CH_2)_a—NHCONHNHCO—(CH_2)_{m-1}CH_3$ |

In addition, specific examples of such compounds having formula (18) include compounds similar to those shown in Table 7.

More specifically, examples of the compounds having the formula, $CH_3(CH_2)_{m'-1}$,—$NHCONH—(CH_2)_{m-1}CH_3$, or $CH_3(CH_2)_{m'-1}—NHCONH—(CH_2)_a—NHCONH—(CH_2)_{m'-1}CH_3$, which are shown in Table 7 include compounds shown in Table 8.

TABLE 8

| |
|---|
| $CH_3(CH_2)_{17}—NHCONH—(CH_2)_{17}CH_3$ |
| $CH_3(CH_2)_{17}—NHCONH—CH_3$ |
| $CH_3(CH_2)_{17}—NHCONH—(CH_2)_5CH_3$ |
| $CH_3(CH_2)_{17}—NHCONH—(CH_2)_{11}CH_3$ |
| $CH_3(CH_2)_{17}—NHCONH—(CH_2)_{14}CH_3$ |
| $CH_3(CH_2)_{17}—NHCONH—(CH_2)_{21}CH_3$ |
| $CH_3(CH_2)_7—NHCONH—CH_2CH_3$ |
| $CH_3(CH_2)_7—NHCONH—(CH_2)_5CH_3$ |
| $CH_3(CH_2)_{21}—NHCONH—(CH_2)_3CH_3$ |

TABLE 8-continued

| |
|---|
| $CH_3(CH_2)_{21}—NHCONH—(CH_2)_8CH_3$ |
| $CH_3(CH_2)_{21}—NHCONH—(CH_2)_{14}CH_3$ |
| $CH_3(CH_2)_{21}—NHCONH—(CH_2)_{21}CH_3$ |
| $CH_3(CH_2)_{17}—NHCONH—(CH_2)_{12}—NHCONH—(CH_2)_{17}CH_3$ |
| $CH_3(CH_2)_{17}—NHCONH—(CH_2)_6—NHCONH—(CH_2)_{17}CH_3$ |
| $CH_3(CH_2)_{17}—NHCONH—(CH_2)_2—NHCONH—(CH_2)_{17}$ |
| $CH_3(CH_2)_{21}—NHCONH—(CH_2)_6—NHCONH—(CH_2)_{21}CH_3$ |
| $CH_3(CH_2)_{21}—NHCONH—(CH_2)_{12}—NHCONH—(CH_2)_{21}CH_3$ |
| $CH_3(CH_2)_{21}—NHCONH—(CH_2)_6—NHCONH—(CH_2)_{21}CH_3$ |
| $CH_3(CH_2)_{21}—NHCONH—(CH_2)_3—NHCONH—(CH_2)_{21}CH_3$ |
| $CH_3—NHCONH—(CH_2)_{12}—NHCONH—CH_3$ |
| $CH_3(CH_2)_2—NHCONH—(CH_2)_{18}—NHCONH—(CH_2)_2CH_3$ |
| $CH_3—NHCONH—(CH_2)_6—NHCONH—(CH_2)_{17}CH_3$ |
| $CH_3(CH_2)_5—NHCONH—(CH_2)_6—NHCONH—(CH_2)_5CH_3$ |
| $CH_3(CH_2)_5—NHCONH—(CH_2)_{12}—NHCONH—(CH_2)_5CH_3$ |

The content of the color formation/erasure controlling agent in the recording layer is preferably from about 0.1 to about 300% by weight, and more preferably from about 3 to 100% by weight, of the coloring developer in the recording layer.

The recording layer of the reversible thermosensitive recording material of the present invention preferably includes one of leuco dyes having the following formulas (3), (5) and (6) which serve as an electron donating compound, to obtain good color forming ability.

(3)

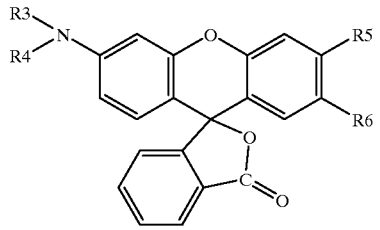

wherein R3 and R4 independently represent a lower alkyl group, an aryl group which is optionally substituted, or a hydrogen atom, and R3 and R4 may combine with each other to form a ring; R5 represents a lower alkyl group, a halogen atom or a hydrogen atom; and R6 represents a lower alkyl group, a halogen atom, a hydrogen atom or a substituted anilino group having the following formula (4), (4)

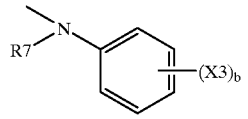

wherein R7 represents a lower alkyl group or a hydrogen atom; and X3 represents a lower alkyl group or a halogen atom; and b is 0 or an integer of from 1 to 3;

(5)

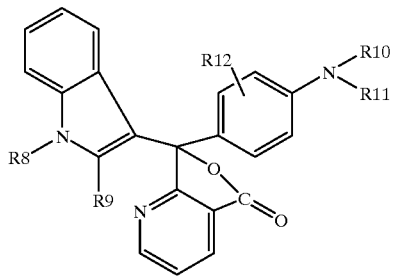

wherein R8–R11 independently represent an alkyl group or a hydrogen atom; and R12 represents an alkyl group, an alkoxy group or a hydrogen atom; and (6)

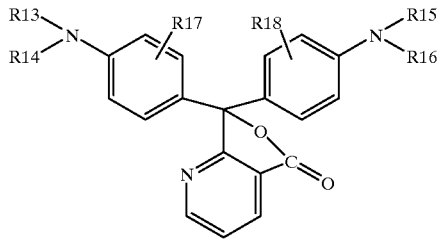

wherein R13–R16 independently represent a lower alkyl group or a hydrogen atom; and R17 and R18 independently represent an alkyl group, an alkoxy group or a hydrogen atom.

Specific examples of leuco dyes for use as a coloring agent in the recording layer of the recording material of the present invention include, but are not limited to:

2-anilino-3-methyl-6-diethylaminofluoran,
2-anilino-3-methyl-6-(di-n-butylamino)fluoran,
2-anilino-3-methyl-6-(N-n-propyl-N-methylamino) fluoran,
2-anilino-3-methyl-6-(N-isopropyl-N-methylamino) fluoran,
2-anilino-3-methyl-6-(N-isobutyl-N-methylamino) fluoran,
2-anilino-3-methyl-6-(N-n-amyl-N-methylamino) fluoran,
2-anilino-3-methyl-6-(N-sec-butyl-N-methylamino) fluoran,
2-anilino-3-methyl-6-(N-n-amyl-N-ethylamino)fluoran,
2-anilino-3-methyl-6-(N-n-isoamyl-N-ethylamino) fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino) fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide, and
3,3-bis(2-ethoxy-4-diethylaminophenyl)-7-azaphthalide.

The coloring agent for use in the recording layer of the present invention may include conventional leuco dyes. Specific examples of such conventional leuco dyes which are employed alone or in combination include:

2-(p-acetylanilino)-6-(N-n-amyl-N-n-butylamino) fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran, 2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino) fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran,
1,2-benzo-6-(N-ethyl-p-toluidino)fluoran,
2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino) fluoran,
2-(α-phenylethylamino)-4-methyl-6-diethylaminofluoran,
2-(p-toluidino)-3-(t-butyl)-6-(N-methyl-p-toluidino) fluoran,
2-(o-methoxycarbonylanilino)-6-diethylaminofluoran,
2-acetylamino-6-(N-methyl-p-toluidino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino) fluoran,
2-(α-phenylethylamino)-4-chloro-6-diethylaminofluoran, 2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino) fluoran,
2-mesidino-4',5'-benzo-6-diethylaminofluoran,
2-(m-trifluoromethylanilino)-3-methyl-6-pyrrolidino fluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholino fluoran,
2-(di-N-p-chlorophenyl-methylamino)-6-pyrrolidino fluoran,
2-(N-n-propyl-m-trifluoromethylanilino)-6-morpholino fluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran, benzoleucomethyleneblue,
2-[3,6-bis(diethylamino)]-6-(o-chloroanilino)xanthyl benzoic acid lactam,
2-[3,6-bis(diethylamino)]-9-(o-chloroanilino)xanthyl benzoic acid lactam,
3,3-bis(p-dimethylaminophenyl)phthalide,
3,3-bis(p-dimethylaminophenyl)-6-dimethylaminophthalide (i.e., crystal violet lactone)
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-4-chloro-5-methoxyphenyl)phthalide,
3,6-bis(dimethylamino)fluorenespiro(9,3')-6'-dimethylaminophthalide,
6'-chloro-8'-methoxy-benzoindolino-spiropyran, and
6'-bromo-2'-methoxy-benzoindolino-spiropyran.

The recording layer of the recording material of the present invention preferably includes phenolic compounds having the following formula (7) as a coloring developer to obtain good preservability and good resistance to light of the recording material:

(7)

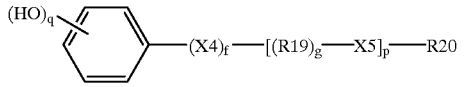

wherein X4 represents a divalent group including a hetero atom and f is 0 or 1; R19 represents a divalent hydrocarbon group and g is 0 or 1; X5 represents a divalent group having a hetero atom; R20 represents a hydrocarbon group having from 1 to 22 carbon atoms; p is 0 or an integer of from 1 to 4, and when p is 2 to 4, each of R19 may be the same or different from each other and each of X5 may be the same or different from each other; and q is an integer of from 1 to 3.

In formula (7), R19 and R20 are independently a hydrocarbon group which is optionally substituted with a group such as a hydroxy group, a halogen atom or an alkoxy group and which may be aliphatic hydrocarbon groups, aromatic hydrocarbon groups or hydrocarbon groups having both an aliphatic hydrocarbon group and an aromatic hydrocarbon group. The aliphatic hydrocarbon groups may be linear or branched, and may include an unsaturated bonding. The total carbon number of R19 and R20 is preferably not less than 7, and more preferably not less than 10, to maintain good color formation/erasure properties of the recording material.

Suitable groups for use as R19 include groups shown in Table 9 other than a direct bonding.

TABLE 9

| |
|---|
| $-(CH_2)_q-$ $-(CH_2)_q-CH=CH-(CH_2)_{q'}-$ |
| $-(CH_2)_q-C_6H_4-(CH_2)_{q'}-$ |
| $-(CH_2)_q-CH(CH_2)_{q''}-CH_3-(CH_2)_{q'}-$ $-(CH_2)_q-CH(CH_2)_{q''}-Cl-(CH_2)_{q'}-$ |

TABLE 9-continued

| |
|---|
| $-(CH_2)_q-C(CH_2)_{q'''}-CH_3)(CH_2)_{q''}-CH_3-(CH_2)_{q'}-$ $-(CH_2)_q-CH(CH_2)_{q''}-OH-(CH_2)_{q'}-$ |

wherein q, q', q" and q'" are independently an integer.

Suitable groups for use as R20 include groups shown in Table 10.

TABLE 10

| |
|---|
| $-(CH_2)_q-CH_3$ $-(CH_2)_q-CH=CH-(CH_2)_{q'}-CH_3$ |
| $-(CH_2)_q-C_6H_4-(CH_2)_{q'}-CH_3$ $-(CH_2)_q-C_6H_5$ |
| $-(CH_2)_q-C_6H_4-Cl$ $-(CH_2)_q-CH(CH_2)_{q''}-CH_3-(CH_2)_{q'}-CH_3$ |
| $-(CH_2)_q-C(CH_2)_{q'''}-CH_3)(CH_2)_{q''}-CH_3-(CH_2)_{q'}-CH_3$ $-(CH_2)_q-CH(CH_2)_{q''}-OH-(CH_2)_{q'}-CH_3$ |

wherein q, q', q" and q'" are independently an integer which is not greater than the carbon atoms of R20, and the total carbon number in a group is not greater than the carbon number of R20.

Suitable groups for use as X4 and X5 include divalent groups including at least one of groups, —NH—, —CO—, —O—, —S— and —$SO_2$—. Specific examples of such groups include groups shown in Table 11.

TABLE 11

| |
|---|
| $-N(H)-C(=O)-$ $-N(H)-C(=O)-N(H)-$ $-C(=O)-N(H)-$ $-O-C(=O)-O-$ $-C(=O)-O-$ $-O-C(=O)-$ |
| $-N(H)-S(=O)_2-$ $-S(=O)_2-N(H)-$ $-S-C(=O)-$ $-C(=O)-S-$ $-N(H)-C(=S)-N(H)-$ $-S-S-$ |
| $-O-C(=O)-N(H)-$ $-N(H)-C(=O)-O-$ $-O-C(=S)-N(H)-$ $-N(H)-C(=S)-O-$ $-S(=O)_2-$ |
| $-CH=N-$ $-N=CH-$ $-N(H)-$ $-C(=O)-$ $-O-$ $-S-$ |

TABLE 11-continued
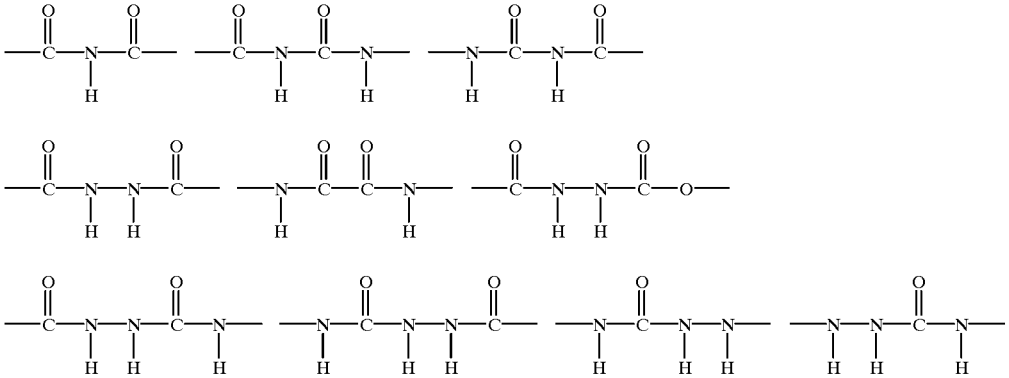
More preferably, the phenolic compounds for use as a coloring developer in the recording layer include compounds shown in Table 12.
TABLE 12
(19)
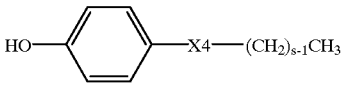
(20)
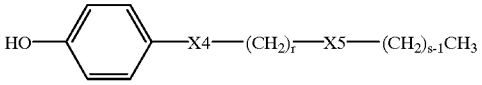
(21)
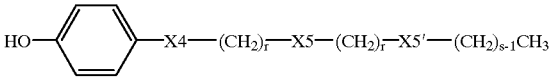
(22)
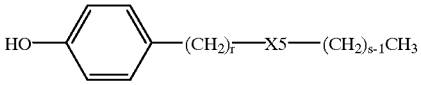
(23)
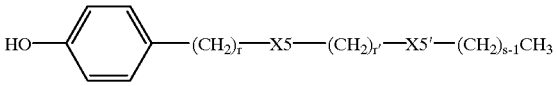
(24)
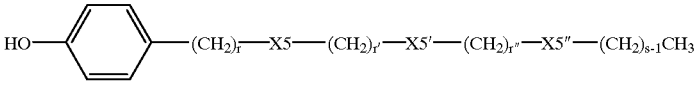
(25)
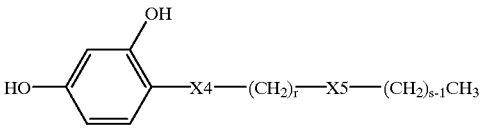
(26)
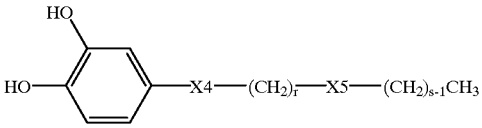

TABLE 12-continued

| | |
|---|---|
| HO, HO, HO—, —X4—$(CH_2)_r$—X5—$(CH_2)_{s-1}CH_3$ | (27) |

wherein r, r' and s are independently an integer under the conditions that R19 and R20 are the groups mentioned above, and X5' and X5" independently represent one of the groups which are described for use as X5.

More specifically, specific examples of the compounds having formula (20) include compounds shown in Table 13, but are not limited thereto.

TABLE 13

| |
|---|
| HO—, —NHCO—$(CH_2)_r$—NHCO—$(CH_2)_{s-1}CH_3$ |
| HO—, —NHCO—$(CH_2)_r$—CONH—$(CH_2)_{s-1}CH_3$ |
| HO—, —NHCO—$(CH_2)_r$—NHCOCONH—$(CH_2)_{s-1}CH_3$ |
| HO—, —NHCO—$(CH_2)_r$—CONHNHCO—$(CH_2)_{s-1}CH_3$ |
| HO—, —NHCO—$(CH_2)_r$—NHCONH—$(CH_2)_{s-1}CH_3$ |
| HO—, —NHCO—$(CH_2)_r$—$NHSO_2$—$(CH_2)_{s-1}CH_3$ |
| HO—, —NHCO—$(CH_2)_r$—$NHSO_2NHCO$—$(CH_2)_{s-1}CH_3$ |
| HO—, —NHCO—$(CH_2)_r$—OCO—$(CH_2)_{s-1}CH_3$ |
| HO—, —NHCO—$(CH_2)_r$—COO—$(CH_2)_{s-1}CH_3$ |
| HO—, —NHCO—$(CH_2)_r$—OCONH—$(CH_2)_{s-1}CH_3$ |

TABLE 13-continued

| |
|---|
| HO—, —NHCO—$(CH_2)_r$—$OCO_2$—$(CH_2)_{s-1}CH_3$ |
| HO—, —NHCO—$(CH_2)_r$—NHCOO—$(CH_2)_{s-1}CH_3$ |
| HO—, —CONH—$(CH_2)_r$—NHCO—$(CH_2)_{s-1}CH_3$ |
| HO—, —CONH—$(CH_2)_r$—CONH—$(CH_2)_{s-1}CH_3$ |
| HO—, —CONH—$(CH_2)_r$—NHCOCONH—$(CH_2)_{s-1}CH_3$ |
| HO—, —CONH—$(CH_2)_r$—CONHNHCO—$(CH_2)_{s-1}CH_3$ |
| HO—, —CONH—$(CH_2)_r$—NHCONH—$(CH_2)_{s-1}CH_3$ |
| HO—, —COO—$(CH_2)_r$—NHCO—$(CH_2)_{s-1}CH_3$ |
| HO—, —COO—$(CH_2)_r$—CONH—$(CH_2)_{s-1}CH_3$ |
| HO—, —COO—$(CH_2)_r$—NHCOCONH—$(CH_2)_{s-1}CH_3$ |
| HO—, —COO—$(CH_2)_r$—CONHNHCO—$(CH_2)_{s-1}CH_3$ |

TABLE 13-continued
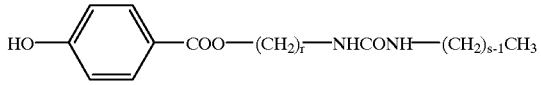
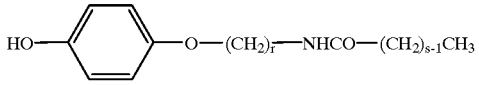
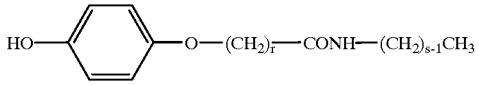
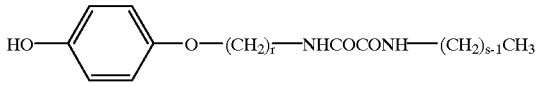
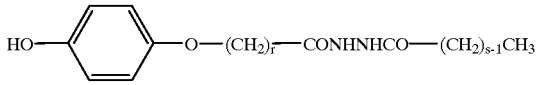
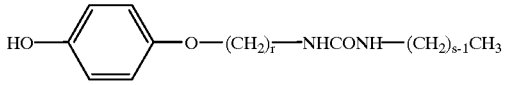
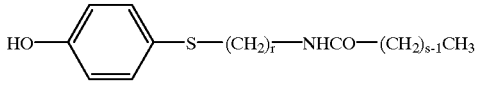
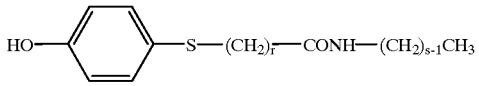
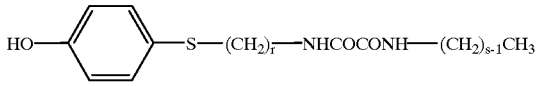
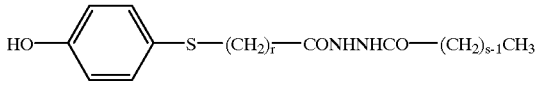
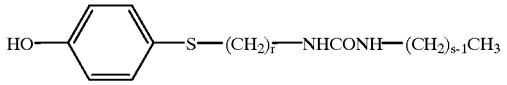
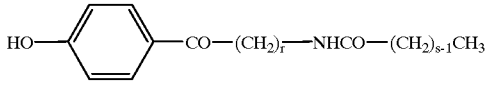
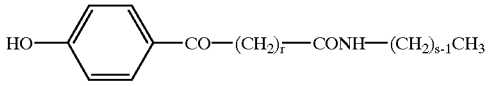
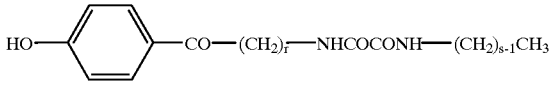
TABLE 13-continued
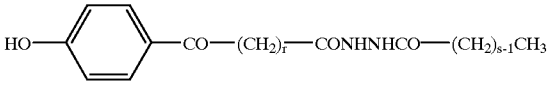
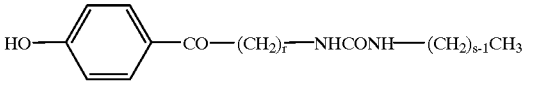
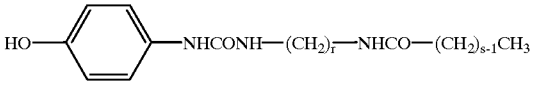
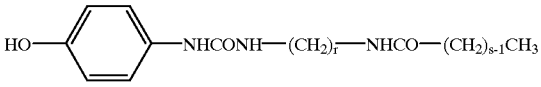
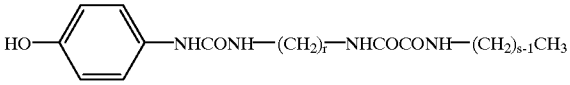
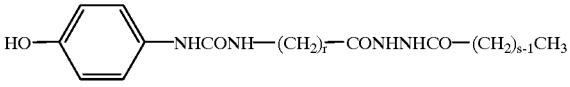
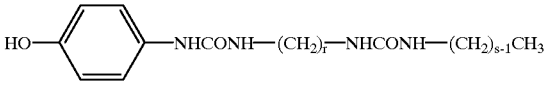
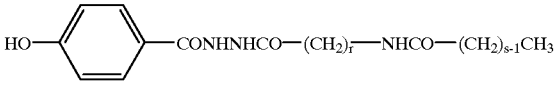
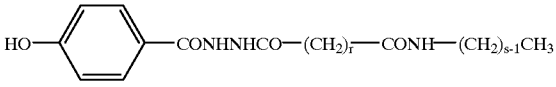
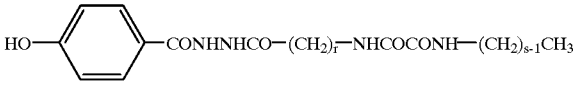
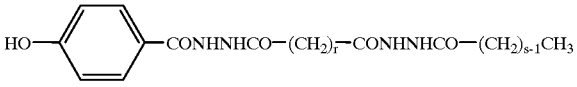
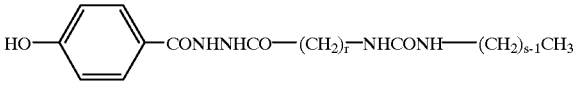
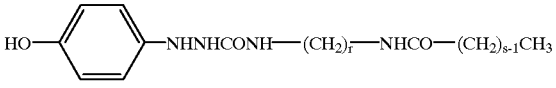
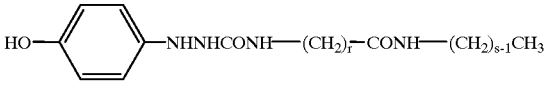

TABLE 13-continued

| |
|---|
| HO—C6H4—NHNHCONH—(CH2)r—NHCOCONH—(CH2)s-1CH3 |
| HO—C6H4—NHNHCONH—(CH2)r—CONHNHCO—(CH2)s-1CH3 |
| HO—C6H4—NHNHCONH—(CH2)r—NHCONH—(CH2)s-1CH3 |
| HO—C6H4—NHCOCONH—(CH2)r—NHCO—(CH2)s-1CH3 |
| HO—C6H4—NHCOCONH—(CH2)r—CONH—(CH2)s-1CH3 |
| HO—C6H4—NHCOCONH—(CH2)r—NHCOCONH—(CH2)s-1CH3 |
| HO—C6H4—NHCOCONH—(CH2)r—CONHNHCO—(CH2)s-1CH3 |
| HO—C6H4—NHCOCONH—(CH2)r—NHCONH—(CH2)s-1CH3 |

Similarly, specific examples of the phenolic compounds having formulas (19), and (21) to (27) include compounds similar to those shown in Table 13, but are not limited thereto.

Even more specifically, specific examples of the phenolic compounds having the following formula shown in Table 13 include compounds shown in Table 14.

TABLE 14

| |
|---|
| HO—C6H4—NHCO—(CH2)r—NHCO—(CH2)s-1CH3 |
| HO—C6H4—NHCO—(CH2)2—NHCO—(CH2)10CH3 |
| HO—C6H4—NHCO—(CH2)2—NHCO—(CH2)12CH3 |
| HO—C6H4—NHCO—(CH2)2—NHCO—(CH2)14CH3 |

TABLE 14-continued

| |
|---|
| HO—C6H4—NHCO—(CH2)2—NHCO—(CH2)15CH3 |
| HO—C6H4—NHCO—(CH2)2—NHCO—(CH2)16CH3 |
| HO—C6H4—NHCO—(CH2)2—NHCO—(CH2)20CH3 |
| HO—C6H4—NHCO—(CH2)3—NHCO—(CH2)16CH3 |
| HO—C6H4—NHCO—(CH2)5—NHCO—(CH2)16CH3 |
| HO—C6H4—NHCO—(CH2)7—NHCO—(CH2)16CH3 |
| HO—C6H4—NHCO—(CH2)11—NHCO—(CH2)15CH3 |
| HO—C6H4—NHCO—(CH2)12—NHCO—(CH2)16CH3 |
| HO—C6H4—NHCO—(CH2)11—NHCO—(CH2)2CH3 |
| HO—C6H4—NHCO—(CH2)11—NHCO—(CH2)3CH3 |
| HO—C6H4—NHCO—(CH2)11—NHCO—(CH2)5CH3 |
| HO—C6H4—NHCO—(CH2)11—NHCO—(CH2)11CH3 |
| HO—C6H4—NHCO—(CH2)11—NHCO—(CH2)13CH3 |
| HO—C6H4—NHCO—(CH2)11—NHCO—(CH2)21CH3 |

Among these coloring developers, compounds having the following formula (8) are preferable.

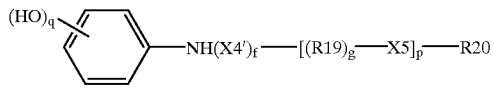

(8)

wherein X4' represents a divalent group including a hetero atom and f is 0 or 1; X5 represents a divalent group including a hetero atom; R19 represents a divalent hydrocarbon group and g is 0 or 1; R20 represents a hydrocarbon group having from 1 to 22 carbon atoms; p is 0 or an integer of from 1 to 4, and when p is 2 or more, each of R19 may be the same or different from each other and each of X5 may be the same or different from each other; and q is an integer of from 1 to 3.

In the present invention, other compounds can also be employed as a coloring developer in combination with the phenolic compounds mentioned above.

Suitable compounds for use as a coloring developer in combination with the phenolic compounds mentioned above include compounds which have both a structure capable of developing a coloring agent and a structure capable of controlling cohesive force and which are disclosed in Japanese Laid-Open Patent Publication No. 5-124360 in which organic phosphate compounds, carboxylic acid compounds and phenolic compounds each of which has a long chain hydrocarbon group are exemplified as a typical coloring developer. Specific examples of such compounds include:

organic phosphates compounds dodecyl phosphonate, tetradecyl phosphonate, hexadecyl phosphonate, octadecyl phosphonate, eicosyl phosphonate, docosyl phosphonate, tetracosyl phosphonate, ditetradecyl phosphate, dihexadecyl phosphate, dioctadecyl phosphate, dieicosyl phosphate and dibehenyl phosphate;

aliphatic carboxylic acid compounds 2-hydroxy tetradecanoic acid, 2-hydroxy hexadecanoic acid, 2-hydroxy octadecanoic acid, 2-hydroxy eicosanoic acid, 2-hydroxy docosanoic acid, 2-bromo hexadecanoic acid, 2-bromo octadecanoic acid, 2-bromo eicosanoic acid, 2-bromo docosanoic acid, 3-bromo octadecanoic acid, 3-bromo docosanoic acid, 2, 3-dibromo octadecanoic acid, 2-fluoro dodecanoic acid, 2-fluoro tetradecanoic acid, 2-fluoro hexadecanoic acid, 2-fluoro octadecanoic acid, 2-fluoro eicosanoic acid, 2-fluoro docosanoic acid, 2-iodo hexadecanoic acid, 2-iodo octadecanoic acid, 3-iodo hexadecanoic acid, 3-iodo octadecanoic acid and perfluoro octadecanoic acid; and aliphatic dicarboxylic acid compounds and aliphatic tricarboxylic acid compounds 2-dodecyloxysuccinic acid, 2-tetradecyloxysuccinic acid, 2-hexadacyloxysuccinic acid, 2-octadecyloxysuccinic acid, 2-eicosyloxysuccinic acid, 2-docosyloxysuccinic acid, 2-dodecylthiosuccinic aid, 2-tetradecylthiosuccinic acid, 2-hexadecylthiosuccinic acid, 2-octadecylthiosuccinic acid, 2-eicosylthiosuccinic acid, 2-docosylthiosuccinic acid, 2-tetracosylthiosuccinic acid, 2-hexadecyldithiosuccinic acid, 2-octadecyldithiosuccinic acid, 2-eicosyldithiosuccinic acid, dodecylsuccinic acid, tetradecylauccinic acid, pentadecylsuccinic acid, hexadecylsuccinic acid, octadecylsuccinic acid, eicosylsuccinic acid, docosylsuccinic acid, 2,3-dihexadecylsuccinic acid, 2,3-dioctadecylsuccinic acid, 2-methyl-3-hexadecylsuccinic acid, 2-methyl-3-octadecylsuccinic aicd, 2-octadecyl-3-hexadecylsuccinic acid, hexadecylmalonic acid, octadecylmalonic acid, eicosylmalonic acid, docosylmalonic acid, dihexadecylmalonic acid, dioctadecylmalonic acid, didocosylmalonic acid, methyloctadecylmalonic acid, 2-hexadecylglutaric acid, 2-octadecylglutaric acid, 2-eicosylglutaric acid, docosylglutaric acid, 2-pentadecyladipic acid, 2-octadecyladipic acid, 2-eicosyladipic acid, 2-docosyladipic acid, 2-hexadecanoyloxy propane-1,2,3-tricarboxylic acid and 2-octadecanoyloxy propane-1,2,3-tricarboxylic acid.

The mixing ratio of the coloring agent and the coloring developer in the recording layer, which depends on the materials of the coloring agent and the coloring developer used, is from about 1/0.1 to about 1/20 by mole, and preferably from about 1/0.2 to about 1/10, to maintain good image density of the recorded image.

The recording layer preferably includes a crosslinked resin to obtain good heat resistance. In addition, the protective layer preferably includes a crosslinked resin to make the recording material resistant to heat of a recording device such as a thermal printhead and to make the recording material and recorded images resistant to chemicals, water, light and rubbing.

A crosslinked resin can be obtained by heating a mixture of a crosslinking agent and a crosslinkable resin having an active group which can react with the crosslinking agent upon application of heat.

Specific examples of such a heat-crosslinkable resin include resins having an active group such as a hydroxy group, a carboxy group and the like, e.g., phenoxy resins, polyvinyl butyral resins, cellulose acetate propionate and cellulose acetate butyrate. In addition, a copolymer of a monomer having an active group such as a hydroxy group, a carboxyl group or the like and a monomer such as vinyl chloride, an acrylic monomer, styrene or the like can be employed. Specific examples of such a copolymer include vinyl chloride-vinyl acetate-vinyl alcohol copolymers, vinyl chloride-vinyl acetate-hydroxypropyl acrylate copolymers, vinyl chloride-vinyl acetate-maleic anhydride copolymers and the like.

Suitable crosslinking agents which can crosslink these resins upon application of heat include isocyanate compounds, amino resins, phenol resins, amines, epoxy compounds and the like. For example, specific examples of such isocyanate compounds include poly isocyanate compounds having a plurality of isocyanate groups such as hexamethylene diisocyanate (HDI), tolylene diisocyanate (TDI), xylylene diisocyanate (XDI), and adducts of these isocyanate compounds with trimethylol propane and the like, buret type compounds of these isocyanate compounds, isocyanurate type compounds of these isocyanate compounds and blocked isocyanate compounds of these isocyanate compounds.

As for the addition quantity of the crosslinking agents, the ratio of the number of active groups included in the resin to the number of functional groups included in the crosslinking agent is preferably from about 0.01 to about 2 to maintain good heat resistance and good image formation/erasure properties of the recording material.

In addition, the recording layer and the protective layer may include a crosslinking promoter, which is a catalyst useful for this kind of reaction, for example, tertiary amines such as 1,4-diaza-bicyclo(2,2,2) octane, and metal compounds such as organic tin compounds.

Crosslinking can be effected by application of an electron beam or ultraviolet light. Suitable monomers useful for forming a crosslinked recording layer and protective layer which can be crosslinked upon application of electron beam or ultraviolet light include, but are not limited to:

monomers having one functional group methyl methacrylate, ethyl methacrylate, n-butyl methacrylate, iso-butyl methacrylate, t-butyl methacrylate, 2-ethylhexyl methacrylate, lauryl methacrylate, tridecyl methacrylate, stearyl methacrylate, cyclohexyl methacrylate, benzyl methacrylate, methacrylic acid, 2-hydroxyethyl methacrylate, 2-hydroxypropyl methacrylate, dimethylaminoethyl methacrylate, methyl chloride salts of dimethylaminoethyl methacrylate, diethylaminoethyl methacrylate, glycidyl methacrylate, tetrahydrofurfuryl methacrylate, allyl methacrylate, 2-ethoxyethyl methacrylate, 2-ethylhexyl acrylate, 2-ethoxyethyl acrylate, 2 -ethoxyethoxyethyl acrylate, 2-hydroxyethyl acrylate, 2-hydroxypropyl acrylate, dicyclopentenylethyl acrylate, N-vinyl pyrrolidone and vinyl acetate.

monomers having two functional groups ethylene glycol dimethacrylate, triethylene glycol dimethacrylate, tetraethylene glycol dimethacrylate, 1,3-butylene glycol dimethacrylate, 1,6-hexanediol dimethacrylate, 1,4-butanediol diacrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, diacrylate esters of an adduct of bisphenol A with ethylene oxide, glycerin methacrylate acrylate, diacrylate esters of an adduct of neopentyl glycol with two moles of propylene oxide, diethylene glycol diacrylate, polyethylene glycol (400) diacrylate, diacrylate esters of an ester of hydroxy pivalate and neopentyl glycol, 2,2-bis(4-acryloyloxydiethoxyphenyl) propane, neopentyl glycol diadipate diacrylate, diacrylate esters of an adduct of neopentyl glycol hydroxypivalate with ϵ-caprolactone, 2-(2-hydroxy-1,1-dimethylethyl)-5-hydroxymethyl-5-ethyl-1, 3-dioxane diacrylate, tricyclodecane dimethylol diacrylate, adducts of tricyclodecane dimethylol diacrylate with ϵ-caprolactone, and 1,6-hexanediol glycidyl ether diacrylate.

monomers having three or more functional groups trimethylol propane trimethacrylate, trimethylol propane triacrylate, acrylate esters of an adduct of glycerin with propylene oxide, trisacryloyloxyethyl phosphate, pentaerythritol acrylate, triacrylate esters of an adduct of trimethylol propane with three moles of propylene oxide, dipentaerythritol polyacrylate, polyacrylate esters of an adduct of dipentaerythritol with ϵ-caprolactone, dipentaerythritol propionate triacrylate, triacrylate esters of hydroxypivalic aldehyde modified dimethylol propane, dipentaerythritol propionate tetraacrylate, ditrimethylol propane tetraacrylate, dipentaerythritol propionate pentaacrylate, dipentaerythritol hexaacrylate and adducts of dipentaerythritol hexaacrylate with ϵ-caprolactone.

oligomers adducts of bisphenol A with diepoxy acrylic acid.

When a resin is crosslinked using ultraviolet light, one or more of the following photopolymerization initiators and photopolymerization promoters can be used in the recording layer and the protective layer.

Specific examples of such photopolymerization initiators include:

benzoin ethers such as isobutyl benzoin ether, isopropyl benzoin ether, benzoin ethyl ether and benzoin methyl ether; α-acyloxime esters such as 1-phenyl-1,2-propanedione-2-(o-ethoxycarbonyl)oxime; benzyl ketals such as 2,2-dimethoxy-2-phenyl acetophenone and benzyl hydroxycyclohexylphenyl ketone; acetophenone derivatives such as diethoxy acetophenone and 2-hydroxy-2-methyl-1-phenylpropane-1-one; and ketones such as benzophenone, 1 -chlorothioxanthone, 2-chlorothioxanthone, isopropylthioxanthone, 2-methylthioxanthone and 2-chlorobenzophenone. These photopolymerization initiators are employed alone or in combination.

The content of the photopolymerization initiator in the recording layer or the protective layer is preferably from about 0.005 to about 1.0 part by weight, and more preferably from about 0.01 to about 0.5 part by weight, per 1 part by weight of the monomer or the oligomer.

Suitable photopolymerization promoters include aromatic tertiary amines and aliphatic amines. Specific examples of such photopolymerization promoters which are employed alone or in combination include p-dimethylamino benzoic acid isoamyl ester, p-dimethylamino benzoic acid ethyl ester and the like. The content of the photopolymerization promoter in the recording layer or the protective layer is preferably from about 0.1 to about 5 parts by weight, and more preferably from about 0.3 to about 3 parts by weight, per 1 part by weight of the photopolymerization initiator.

Suitable light sources useful for irradiating ultraviolet light include mercury-vapor lamps, metal-halide lamps, gallium lamps, mercury-xenon lamps, flashing lamps and the like. The light source should be selected so that the spectrum of the ultraviolet light irradiated from the light source corresponds to the absorption spectrum of the photopolymerization initiator and the photopolymerization promoter included in the protective layer. Irradiation conditions of ultraviolet light such as output of lamp power, irradiation width and feeding speed (i.e., irradiation time) should be determined so that the resin in the recording layer or the protective layer can be securely crosslinked.

Electron beam irradiation apparatus includes scanning type and non-scanning type electron beam irradiation apparatus which is selected depending on the irradiation area and the irradiation dose required for crosslinking the recording layer or the protective layer. Irradiation conditions such as electron beam current, irradiation width and irradiation speed should be determined depending on the irradiation dose required for crosslinking the resin included in the recording layer or the protective layer.

The recording layer of the recording material of the present invention is a layer in which a coloring agent and a coloring developer are included in a crosslinked resin. More preferably, the coloring agent and the coloring developer are finely and uniformly dispersed in the crosslinked resin. Even more preferably, the coloring agent and the coloring developer are dispersed while they form complex particles. These complex particles can be obtained, for example, by melting (or dissolving in a solvent) a mixture of a coloring agent and a coloring developer and then cooling the mixture (or drying the solvent). The recording layer including the complex particles can be obtained by coating on a substrate a recording layer coating liquid in which each of a coloring agent and a coloring developer is dispersed or dissolved in a respective solvent and then mixed, or both of them are dispersed or dissolved in a solvent, and then drying the coated liquid. The coloring agent and the coloring developer may be used while being microencapsulated. The recording layer can be crosslinked by a heat crosslinking method, an ultraviolet light crosslinking method or an electron beam crosslinking method. Crosslinking conditions depend on the material of the crosslinkable resin used in the recording layer. For example, the recording layer can be crosslinked upon application of high temperature heat for a short time or can be crosslinked upon application of low temperature heat for a long time. The recording layer can also be crosslinked by the ultraviolet light crosslinking method or the electron beam crosslinking method.

The weight ratio of the total of the coloring agent and the coloring developer to the resin in the recording layer is preferably from about 0.1/1 to about 10/1 to maintain good heat resistance of the recording layer and good image density of the recorded image.

The recording layer of the recording material of the present invention may include auxiliary agents such as dispersants, surfactants, electroconductive agents, fillers, lubricants, antioxidants, photostabilizers, ultraviolet light absorbing agents, color formation stabilizers, and color erasure promoters.

The recording layer may include a thermoplastic resin together with the crosslinked resin. Specific examples of such a thermoplastic resin include polyvinyl chloride resins, polyvinyl acetate resins, vinyl chloride-vinyl acetate copolymers, polystyrene resins, styrene copolymers, phenoxy resins, polyester resins, aromatic polyester resins, polyurethane resins, polycarbonate resins, polyacrylate resins, polymethacrylate resins, acrylic copolymers and maleic anhydride copolymers.

The recording material of the present invention may include a protective layer formed on the recording layer. The protective layer preferably includes a crosslinked resin which is crosslinked upon application of heat, ultraviolet light, electron beam, or the like. By using such a crosslinked resin in the protective layer, the recording material has good ability to be used with thermal printheads and good durability even when the recording material is used repeatedly.

Suitable resins for use in the protective layer include the crosslinked resins which are described for use in the recording layer.

The protective layer may include a resin other than the crosslinked resin. Specific examples of such a resin include polyvinyl alcohol resins, styrene-maleic anhydride copolymers, carboxyl modified polyethylene resins, melamine-formaldehyde resins and urea-formaldehyde resins.

The protective layer may include auxiliary agents such as electroconductive agents which are described for use in the recording layer, stick-preventing agents such as cationic polymers, silicone resins, fluorine-containing resins, phosphate compounds and polyoxyethylene compounds, fillers and lubricants which improve the feeding properties and the wearing resistance of the recording material and which prevent the recording material from sticking to a thermal printhead, ultraviolet absorbing agents and the like.

The recording material of the present invention may include an adhesive layer, an intermediate layer, an under-coat layer, a back-coat layer and a magnetic recording layer other than the recording layer and the protective layer formed on the recording layer. These layers may be colored or non-colored. The magnetic recording layer may be formed on the side of a substrate on which the recording layer is formed or on the opposite side of the substrate.

An intermediate layer is preferably formed between the recording layer and the protective layer to obtain good adhesion thereof and to prevent the recording layer from deteriorating, which is caused by the coating operation of the protective layer and the migration of a component included in the protective layer. The intermediate layer and the protective layer preferably have relatively low oxygen transmittance to obtain good light resistance of the recorded image by preventing the coloring agent and the coloring developer from oxidizing caused by contacting with oxygen.

The recording material may include an under-coat layer between the substrate and the recording layer to effectively utilize heat applied for recording images, to obtain good adhesion between the recording layer and the substrate and/or to prevent the substrate from deteriorating caused by contacting with the recording layer coating liquid. The heat insulating under-coat layer can be formed by coating a coating liquid in which hollow particles are dispersed in a resin solution.

Suitable resins for use in the intermediate layer or the under-coat layer include resins which are described for use in the recording layer. In addition, the recording layer, the protective layer, the intermediate layer and the under-coat layer may include an inorganic or an organic filler such as calcium carbonate, magnesium carbonate, titanium dioxide, silica, aluminum hydroxide, kaolin, talc and the like. Further, these layers may include lubricants, surfactants and the like.

A suitable substrate for use in the recording material of the present invention includes any substrate which can support the recording layer, such as paper, resin films, synthetic paper, metal foils, glass plates or complex substrates thereof. The substrate may be non-colored or colored and may be transparent or opaque. The substrate may be a complex substrate in which two or more substrates are combined. Suitable thickness of the substrate is from a few $\mu$m to a few mm.

The recording material of the present invention may be adhered to a supporting material with an adhesive layer. The adhesive layer may be formed on a part of the recording material or on the entire recording material. The recording material which is adhered to a supporting material may be laminated with films or the like.

The recording material of the present invention can be processed into any shape such as sheet, card, roll and the like.

The reversible thermosensitive recording material of the present invention may include an irreversible thermosensitive recording layer. The color of the image of the irreversible thermosensitive recording layer may be the same as or different from that of the reversible thermosensitive recording layer. The irreversible thermosensitive recording layer is preferably formed under the reversible thermosensitive recording layer and the coloring temperature of the irreversible thermosensitive recording layer is preferably higher than that of the reversible thermosensitive recording layer.

In addition, the recording material of the present invention may have a print layer thereon. The print layer can be formed, for example, by offset printing, gravure printing, ink jet printing, thermal transfer printing, sublimation thermal transfer printing or the like. Further, the print layer and the recording material having the print layer may be covered entirely or partially by a protective layer (an overprint layer, i.e., an OP layer) which includes a crosslinked resin.

Images can be recorded in the recording material of the present invention by heating the recording material, for example, with a thermal pen, a thermal printhead, laser or the like, at an image forming temperature for a short time. When the heating is stopped, the applied heat is quickly diffused, namely, the recorded image is quickly cooled; thereby a stable image can be formed in the recording material. The recorded image can be erased by heating the recording layer at a temperature not lower than the image forming temperature T1 with an appropriate heating device and then gradually cooling the recording layer, or by heating the recording layer at a temperature in an image erasing temperature range, i.e., a temperature not lower than the image erasing temperature T2 but lower than the image forming temperature T1. The latter image erasing method is preferable because images can be rapidly erased. In addition, the recorded image can be also erased by heating a wide area of the recording layer or heating the recording layer for a long time and then cooling the recording layer. This is because in each case the recording layer is gradually cooled. Suitable heating devices useful for erasing images include heaters such as a ceramic heater, a plane heater, a heat bar, a heat roller or heat stamp; hot air blowing devices; or thermal printheads. When a thermal printhead is used for erasing images, the heat energy applied to the recording layer is preferably controlled so as to be relatively low compared to the heat energy for image recording by controlling the applied voltage and/or pulse width of a pulse applied to the thermal printhead. By using this method, the image recording and erasing operations can be performed with only one thermal printhead, which allows the so-called "overwriting". Needless to say, images can be erased by heating the recording layer at a temperature in an image erasing temperature range with a heater such as ceramic heaters, plane heaters, heat bars, heat rollers or heat stamps.

Having generally described this invention, a further understanding can be obtained by reference to certain specific examples which are provided herein for purposes of illustration only and are not intended to be limiting. In the descriptions in the following examples, numbers represent weight ratios in parts, unless otherwise specified.

EXAMPLES

Example 1

(Formation of recording layer)

A mixture of the following compounds was pulverized and dispersed in a ball mill in order that the average particle diameter of the solid components in the liquid was from 1 to 4 μm, thus a liquid A was prepared:

| (Formulation of liquid A) | |
|---|---|
| 2-anilino-3-methyl-6-dibutylaminofluoran (coloring agent) | 2 |
| Coloring developer having the following formula | 8 |
| 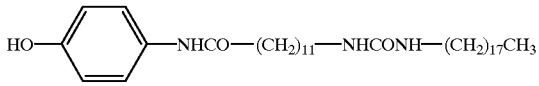 | |
| Color formation/erasure controlling agent having the following formula $CH_3(CH_2)_4$—NHCONH—$(CH_2)_{17}CH_3$ | 2 |
| 15% acryl polyol resin solution (solvent: tetrahydrofuran) | 120 |

Ten (10) parts of adduct type hexamethylene diisocyanate (Colonate HL, manufactured by Nippon Polyurethane Industry Co., Ltd., ethyl acetate solution having a solid content of 75%) were mixed to the liquid A and the mixture was stirred to prepare a recording layer coating liquid.

The recording layer coating liquid was coated with a wire bar on a substrate of a polyethylene terephthalate (PET) film having a thickness of 180 μm, dried at 100° C. for 3 minutes, and then heated at 60° C. for 24 hours to form a recording layer of about 8.0 μm in a dry thickness.

(Formation of protective layer)

The following compounds were mixed to prepare a protective layer coating liquid:

| (Formulation of protective layer coating liquid) | |
|---|---|
| Urethane acrylate type resin crosslinkable with ultraviolet light (C7-157, manufactured by Dainippon Ink and Chemicals Inc.) | 10 |
| Ethyl acetate | 90 |

The thus prepared protective layer coating liquid was coated on the previously prepared recording layer with a wire bar, dried and then fed under an ultraviolet light radiation lamp, whose irradiation power was 80 W/cm, at a feeding speed of 9 m/min to obtain a crosslinked protective layer having a thickness of 3 μm.

Thus, a reversible thermosensitive recording material of the present invention was obtained.

(Image recording method)

An image was recorded in each of three sheets of the recording material using a thermal recording apparatus, manufactured by Ohkura Electric Co., Ltd., under the conditions that the voltage applied to a thermal printhead was 13.3 v and the pulse width was 1.2 ms. The image density of the recorded image which was measured with Macbeth reflection densitometer RD914 was 1.13. The recorded image formed in one of the sheets was then erased by heating at 110° C. for 0.5 seconds using a heat gradient tester manufactured by Toyo Seiki Co., Ltd. to erase the image. The residual image density of the recording material after the image was erased was 0.03. The recording material remained in a good state without deformation of the recording material even after the above-mentioned recording/erasing operation was repeated 50 times.

The image density retention of the recording material was 90% after the image formed in another sheet was preserved in a dry place at 50° C. for 24 hours.

In addition, in order to measure a residual image density after light irradiation, the procedure for image formation and erasure mentioned above was performed using the other sheet of the recording material after the image was exposed to light, which was radiated by a fluorescent lamp and whose illuminance was 5500 lux, for 100 hours. The residual image density after light irradiation was 0.03, and even when these image forming and erasing operations were repeated, there occurred no problem such as misunderstanding of image information in the recording material.

This reversible thermosensitive recording material had such good image formation/erasure properties, good durability, good preservability and good light resistance that the recording material could be stably used for a long time even when applied for practical use.

Example 2

The procedure for preparation of the recording material in Example 1 was repeated except that the coloring developer and the color formation/erasure controlling agent were replaced with the following coloring developer and the following color formation/erasure controlling agent, respectively:

Coloring developer

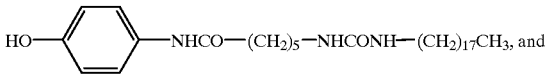

Color formation/erasure controlling agent $CH_3(CH_2)_3$—NHCONH—$(CH_2)_{17}CH_3$.

The procedure for evaluation of the recording material in Example 1 was repeated.

The image density of the recorded image was 1.12. The residual image density of the recording material after the image was erased under the same conditions as mentioned above was 0.02. The recording material remained in a good state without deformation of the recording material even after the above-mentioned recording/erasing operation was repeated 50 times. In addition, the image density retention was 92% and the residual image density after light irradiation was 0.03, and there occurred no problem such as misunderstanding of image information in the recording material even when the image recording/erasing operations were repeated.

This reversible thermosensitive recording material had such good image formation/erasure properties, good durability, good preservability and good light resistance that the recording material could be stably used for a long time even when applied for practical use.

Example 3

The procedure for preparation of the recording material in Example 2 was repeated except that the color formation/erasure controlling agent was replaced with the following color formation/erasure controlling agent:

Color formation/erasure controlling agent $CH_3(CH_2)_{16}$—CONH—$CH_2)_2$—OCO—$(CH_2)_{16}CH_3$.

The procedure for evaluation of the recording material in Example 1 was repeated.

The image density of the recorded image was 1.10. The residual image density was 0.02. The recording material remained in a good state without deformation of the recording material even after the above-mentioned recording/erasing operation was repeated 50 times. In addition, the image density retention was 65% and the residual image density after light irradiation was 0.02, and there occurred no problem such as misunderstanding of image information in the recording material even when the image recording/erasing operations were repeated.

This reversible thermosensitive recording material had such good image formation/erasure properties, good durability, good preservability and good light resistance that the recording material could be stably used for a long time even when applied for practical use.

Example 4

The procedure for preparation of the recording material in Example 2 was repeated except that the coloring agent was replaced with 3-(4-diethylamino-2-ethoxyphenyl)-3-N-ethyl-2-methylindole-3-yl)-4-azaphthalide and the color formation/erasure controlling agent was replaced with the following color formation/erasure controlling agent:

Color formation/erasure controlling agent $CH_3(CH_2)_3$—CONHCO—$(CH_2)_{16}CH_3$.

The procedure for evaluation of the recording material in Example 1 was repeated.

The image density of the recorded image was 0.89. The residual image density was 0.01. The recording material remained in a good state without deformation of the recording material even after the above-mentioned recording/erasing operation was repeated 50 times. In addition, the image density retention was 75% and the residual image density after light irradiation was 0.01, and there occurred no problem such as misunderstanding of image information in the recording material even when the image recording/erasing operations were repeated.

This reversible thermosensitive recording material had such good image formation/erasure properties, good durability, good preservability and good light resistance that the recording material could be stably used for a long time even when applied for practical use.

Example 5

The procedure for preparation of the recording material in Example 4 was repeated except that the color formation/erasure controlling agent was replaced with the following color formation/erasure controlling agent:

Color formation/erasure controlling agent $CH_3(CH_2)_3$—CONH—$(CH_2)_{17}CH_3$.

The procedure for evaluation of the recording material in Example 1 was repeated.

The image density of the recorded image was 0.88. The residual image density was 0.02. The recording material remained in a good state without deformation of the recording material even after the above-mentioned recording/erasing operation was repeated 50 times. In addition, the image density retention was 88% and the residual image density after light irradiation was 0.02, and there occurred no problem such as misunderstanding of image information in the recording material even when the image recording/erasing operations were repeated.

This reversible thermosensitive recording material had such good image formation/erasure properties, good durability, good preservability and good light resistance that the recording material could be stably used for a long time even when applied for practical use.

Example 6

The procedure for preparation of the recording material in Example 4 was repeated except that the color formation/erasure controlling agent was replaced with the following color formation/erasure controlling agent:

Color formation/erasure controlling agent $CH_3(CH_2)_{16}$CONHCO—$(CH_2)_{16}CH_3$.

The procedure for evaluation of the recording material in Example 1 was repeated.

The image density of the recorded image was 0.88. The residual image density was 0.01. The recording material remained in a good state without deformation of the recording material even after the above-mentioned recording/erasing operation was repeated 50 times. In addition, the image density retention was 85% and the residual image density after light irradiation was 0.02, and there occurred no problem such as misunderstanding of image information in the recording material even when the image recording/erasing operations were repeated.

This reversible thermosensitive recording material had such good image formation/erasure properties, good durability, good preservability and good light resistance that the recording material could be stably used for a long time even when applied for practical use.

Example 7

The procedure for preparation of the recording material in Example 2 was repeated except that the coloring agent was replaced with 3,3-bis(2-ethoxy-4-diethylaminophenyl)-4-azaphthalide and the color formation/erasure controlling agent was replaced with the following color formation/erasure controlling agent:

Color formation/erasure controlling agent $$CH_3(CH_2)_5—NHCONH—(CH_2)_{17}CH_3.$$

The procedure for evaluation of the recording material in Example 1 was repeated.

The image density of the recorded image was 0.82. The residual image density was 0.02. The recording material remained in a good state without deformation of the recording material even after the above-mentioned recording/erasing operation was repeated 50 times. In addition, the image density retention was 82% and the residual image density after light irradiation was 0.02, and there occurred no problem such as misunderstanding of image information in the recording material even when the image recording/erasing operations were repeated.

This reversible thermosensitive recording material had such good image formation/erasure properties, good durability, good preservability and good light resistance that the recording material could be stably used for a long time even when applied for practical use.

Example 8

The procedure for preparation of the recording material in Example 2 was repeated except that the color formation/erasure controlling agent was replaced with the following color formation/erasure controlling agent:

Color formation/erasure controlling agent $$CH_3(CH_2)_{17}—NHCONH—(CH_2)_7—COOH.$$

The procedure for evaluation of the recording material in Example 1 was repeated.

The image density of the recorded image was 1.10. The residual image density was 0.02. The recording material remained in a good state without deformation of the recording material even after the above-mentioned recording/erasing operation was repeated 50 times. In addition, the image density retention was 95% and the residual image density after light irradiation was 0.03, and there occurred no problem such as misunderstanding of image information in the recording material even when the image recording/erasing operations were repeated.

This reversible thermosensitive recording material had such good image formation/erasure properties, good durability, good preservability and good light resistance that the recording material could be stably used for a long time even when applied for practical use.

Comparative Example 1

The procedure for preparation of the recording material in Example 1 was repeated except that the color formation/erasure controlling agent was eliminated from the recording layer coating liquid and the coloring developer was replaced with the following coloring developer:

Coloring developer

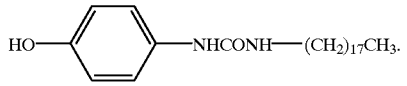

The procedure for evaluation of the recording material in Example 1 was repeated.

The image density of the recorded image was 1.08. The residual image density was 0.03. The recording material remained in a good state without deformation of the recording material even after the above-mentioned recording/erasing operation was repeated 50 times. In addition, the image density retention was 38% and the residual image density after light irradiation was 0.04.

This comparative recording material had relatively low image retention compared to the recording materials of the present invention and therefore image contrast was gradually decreased when repeatedly applied for practical use.

Comparative Example 2

The procedure for preparation of the recording material in Example 1 was repeated except that the color formation/erasure controlling agent was eliminated from the recording layer coating liquid and the coloring developer was replaced with the following coloring developer:

Coloring developer

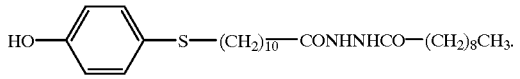

The procedure for evaluation of the recording material in Example 1 was repeated.

The image density of the recorded image was 1.12. The residual image density was 0.20. The recording material remained in a good state without deformation of the recording material even after the above-mentioned recording/erasing operation was repeated 50 times. In addition, the image density retention was 79% and the residual image density after light irradiation was 0.25.

This comparative recording material had relatively high residual image density compared to the recording materials of the present invention because the former images were not clearly erased. Therefore recorded images could not be easily recognized because the former images and the current images were overlapped.

As can be understood from the detailed description of the reversible thermosensitive recording material of the present invention, the reversible thermosensitive recording material of the present invention has good preservability, quick erasability, good durability and good image forming/erasing properties without generating deformation.

Additional modifications and variations of the present invention are possible in light of the above teachings. It is therefore to be understood that within the scope of the appended claims the invention may be practiced other than as specifically described herein.

This application is based on Japanese Patent Applications Nos. 09-185917 and 09-185918, both filed on Jun. 26, 1997, the entire contents of which are herein incorporated by reference.

What is claimed is:

1. A reversible thermosensitive recording material comprising a recording layer which is formed overlying at least one side of a substrate and which comprises an electron donating coloring agent and an electron accepting coloring developer, wherein the recording layer achieves a colored state when heated at a temperature not lower than an image forming temperature and then cooled at a cooling speed (a), and the recording layer in the colored state achieves a non-colored state when heated at a temperature lower than the image forming temperature and not lower than an image erasing temperature, or when heated at a temperature not lower than the image forming temperature and then cooled relatively slowly compared to the cooling speed (a), and wherein the recording layer further comprises at least one color formation/erasure controlling agent having a formula selected from the group consisting of the following formulas (1) and (2):

$$X1—(—R1—X2—)_n—R2 \quad (1)$$

wherein X1 represents a group selected from the group consisting of moieties in Table 3; X2 represents a divalent group selected from the group consisting of moieties in Table 4; R1 represents a divalent hydrocarbon group having from 2 to 20 carbon atoms, and when X1 is a carboxyl group, the R1 group adjacent to X1 is a linear hydrocarbon group having not less than 7 carbon atoms; R2 represents a hydrocarbon group having from 1 to 22 carbon atoms; and n is an integer of from 1 to 4, and when n is 2 or more, each of R1 may be the same or different from each other and each of X2 may be the same or different from each other; and $$R2—Y1—(—R1—Y2—)_n—R2' \quad (2)$$

wherein Y1 and Y2 are independently selected from the group consisting of moieties in Table 4; R1 represents a divalent hydrocarbon group having from 2 to 20 carbon atoms; R2 and R2' independently represent a hydrocarbon group having from 1 to 22 carbon atoms; and n is 0 or an integer of from 1 to 4, and when n is 2 or more, each of R1 may be the same or different from each other and each of Y2 may be the same or different from each other.

2. The reversible thermosensitive recording material according to claim 1, wherein said at least one color formation/erasure controlling agent comprises a compound of formula (1).

3. The reversible thermosensitive recording material according to claim 1, wherein said at least one color formation/erasure controlling agent comprises a compound of formula (2).

4. The reversible thermosensitive recording material according to claim 1, wherein the electron donating coloring agent comprises a fluoran compound having the following formula (3):

(3)

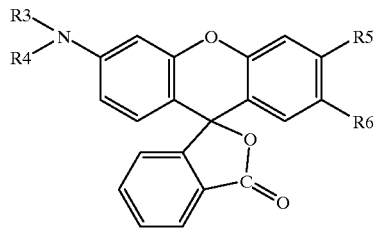

wherein R3 and R4 independently represent a lower alkyl group, an aryl group, a substituted aryl group or a hydrogen atom, and R3 and R4 may combine with each other to form a ring; R5 represents a lower alkyl group, a halogen atom or a hydrogen atom; and R6 represents a lower alkyl group, a halogen atom, a hydrogen atom or a substituted anilino group having the following formula (4):

(4)

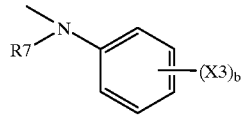

wherein R7 represents a lower alkyl group or a hydrogen atom; X3 represents a lower alkyl group or a halogen atom; and b is 0 or an integer of from 1 to 3.

5. The reversible thermosensitive recording material according to claim 1, wherein the electron donating coloring agent comprises an azaphthalide compound having the following formula (5):

(5)

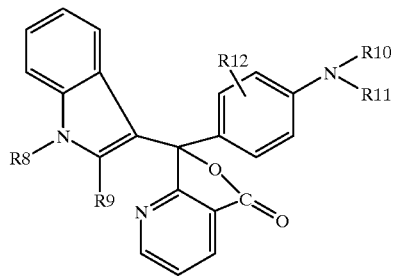

wherein R8, R9, R10 and R11 independently represent an alkyl group or a hydrogen atom; and R12 represents an alkyl group, an alkoxy group or a hydrogen atom.

6. The reversible thermosensitive recording material according to claim 1, wherein the electron donating coloring agent comprises an azaphthalide compound having the following formula (6):

(6)

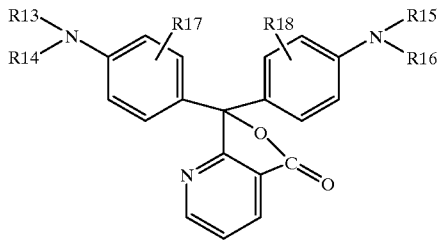

wherein R13, R14, R15 and R16 independently represent a lower alkyl group or a hydrogen atom; and R17 and R18 independently represent an alkyl group, an alkoxy group or a hydrogen atom.

7. The reversible thermosensitive recording material according to claim 1, wherein the electron accepting coloring developer comprises a phenolic compound having the following formula (7):

(7)

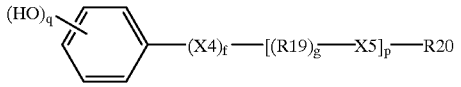

wherein X4 represents a divalent group having a hetero atom and f is 0 or 1; X5 represents a divalent group having a hetero atom; R19 represents a divalent hydrocarbon group and g is 0 or 1; R20 represents a hydrocarbon group having from 1 to 22 carbon atoms; p is 0 or an integer of from 1 to 4, and when p is 2 or more, each of R19 may be the same or different from each other and each of X5 may be the same or different from each other; and q is an integer of from 1 to 3.

8. The reversible thermosensitive recording material according to claim 1, wherein the recording layer further comprises a crosslinked resin.

9. The reversible thermosensitive recording material according to claim 1, wherein the recording material further comprises a protective layer which is formed overlying the recording layer and which comprises a crosslinked resin.

10. The reversible thermosensitive recording material according to claim 1, wherein the recording material is card shaped or sheet shaped.

11. The reversible thermosensitive recording material according to claim 1, wherein the recording material comprises a print layer which is formed overlying at least one side of the substrate.

12. The reversible thermosensitive recording material according to claim 1, wherein the recording material has an image density retention not less than about 60% when the recording material having an image of the colored state is allowed to settle in a dry place at 50° C. for 24 hours, a residual image density not greater than about 0.03 when the recording material having an image of the colored state is heated at 110° C. for 0.5 seconds to erase the image, and a residual image density after light irradiation not greater than about 0.04 when the recording material having an image of the colored state is heated at 110° C. for 0.5 seconds to erase the image after light of 5,000 lux is irradiated to the recording material for 100 hours.

13. The reversible thermosensitive recording material according to claim 1, wherein the electron accepting coloring developer has a long chain alkyl group in which the total number of carbon atoms is not less than 8.

14. A reversible thermosensitive recording method comprising the steps of:

preparing a reversible thermosensitive recording material which comprises a substrate, a recording layer which is formed overlying at least one side of the substrate and which comprises an electron donating coloring agent and an electron accepting coloring developer, said recording material optionally further comprising any one or more of a protective layer which is formed overlying the recording layer, a magnetic recording layer and a print layer, wherein the recording layer achieves a colored state when heated at a temperature not lower than an image forming temperature and then cooled at a cooling speed (a), and the recording layer in the colored state achieves a non-colored state when heated at a temperature lower than the image forming temperature and not lower than an image erasing temperature or when heated at a temperature not lower than the image forming temperature and then cooled relatively slowly compared to the cooling speed (a), and wherein the recording layer further comprises at least one color formation/erasure controlling agent having a formula selected from the group consisting of the following formulas (1) and (2):

$$X1—(—R1—X2—)_n—R2 \quad (1)$$

wherein X1 represents a group selected from the group consisting of moieties in Table 3; X2 represents a divalent group selected from the group consisting of moieties in Table 4; R1 represents a divalent hydrocarbon group having from 2 to 20 carbon atoms, and when X1 is a carboxyl group, the R1 group adjacent to X1 is a linear hydrocarbon group having not less than 7 carbon atoms; R2 represents a hydrocarbon group having from 1 to 22 carbon atoms; and n is an integer of from 1 to 4, and when n is 2 or more, each of R1 may be the same or different from each other and each of X2 may be the same or different from each other; and $$R2—Y1—(—R1—Y2—)_n—R2' \quad (2)$$

wherein Y1 and Y2 are independently selected from the group consisting of moieties in Table 4; R1 represents a divalent hydrocarbon group having from 2 to 20 carbon atoms; R2 and R2' independently represent a hydrocarbon group having from 1 to 22 carbon atoms; and n is 0 or an integer of from 1 to 4, and when n is 2 or more, each of R1 may be the same or different from each other and each of Y2 may be the same or different from each other;

imagewise heating the recording layer at a temperature not lower than the image forming temperature and then cooling the recording layer at the cooling speed (a) to form a colored image in the recording layer; and heating the recording layer at a temperature lower than the image forming temperature and not lower than the image erasing temperature to erase the image.

15. A reversible thermosensitive recording apparatus comprising:

an image forming device which imagewise heats a recording layer of a reversible thermosensitive recording material at a temperature not lower than an image forming temperature to form a colored image, wherein the recording material comprises an electron donating coloring agent and an electron accepting coloring developer in the recording layer and optionally further comprises any one or more of a protective layer, a magnetic layer and a print layer, and wherein the recording layer achieves a colored state when heated at a temperature not lower than the image forming temperature and then cooled at a cooling speed (a), and the recording layer in the colored state achieves a non-colored state when heated at a temperature lower than the image forming temperature and not lower than an image erasing temperature or when heated at a temperature not lower than the image forming temperature and then cooled relatively slowly compared to the cooling speed (a), and wherein the recording layer further comprises at least one color formation/erasure controlling agent having a formula selected from the group consisting of the following formulas (1) and (2):

$$X1—(—R1—X2—)_n—R2 \quad (1)$$

wherein X1 represents a group selected from the group consisting of moieties in Table 3; X2 represents a divalent group selected from the group consisting of moieties in Table 4; R1 represents a divalent hydrocarbon group having from 2 to 20 carbon atoms, and when X1 is a carboxyl group, the R1 group adjacent to X1 is a linear hydrocarbon group having not less than 7 carbon atoms; R2 represents a hydrocarbon group having from 1 to 22 carbon atoms; and n is an integer of from 1 to 4, and when n is 2 or more, each of R1 may be the same or different from each other and each of X2 may be the same or different from each other; and $$R2—Y1—(—R1—Y2—)_n—R2' \quad (2)$$

wherein Y1 and Y2 are independently selected from the group consisting of moieties in Table 4; R1 represents a divalent hydrocarbon group having from 2 to 20 carbon atoms; R2 and R2' independently represent a hydrocarbon group having from 1 to 22 carbon atoms; and n is 0 or an integer of from 1 to 4, and when n is 2 or more, each of R1 may be the same or different from each other and each of Y2 may be the same or different from each other; and an image erasing device which heats the recording layer at a temperature lower than the image forming temperature and not lower than the image erasing temperature to erase the colored image, wherein the erasing device is one of a ceramic heater, a plane heater, a heat roller, a heat bar and a thermal printhead.

* * * * *